US006993206B2

(12) United States Patent
Ishino et al.

(10) Patent No.: US 6,993,206 B2
(45) Date of Patent: Jan. 31, 2006

(54) POSITION DETECTOR AND ATTITUDE DETECTOR

(75) Inventors: Yukinobu Ishino, Setagaya-ku (JP); Tadashi Ohta, Yokohama (JP)

(73) Assignee: Nikon Corporation, Tokyo (JP)

( * ) Notice: Subject to any disclaimer, the term of this patent is extended or adjusted under 35 U.S.C. 154(b) by 691 days.

(21) Appl. No.: 10/098,354

(22) Filed: Mar. 18, 2002

(65) Prior Publication Data

US 2002/0163576 A1 Nov. 7, 2002

(30) Foreign Application Priority Data

Mar. 22, 2001 (JP) ..... 2001-081908
Apr. 2, 2001 (JP) ..... 2001-102934

(51) Int. Cl.
*G06K 9/36* (2006.01)

(52) U.S. Cl. ..... 382/291; 382/103; 382/151

(58) Field of Classification Search ..... 382/103, 382/151, 216, 291, 293, 312; 345/581, 653, 345/654; 348/136, 169; 356/614; 358/1.5, 358/488

See application file for complete search history.

(56) References Cited

U.S. PATENT DOCUMENTS 5,551,876 A * 9/1996 Koresawa et al. ..... 434/16
5,764,786 A * 6/1998 Kuwashima et al. ..... 382/107
5,790,192 A * 8/1998 Konishi et al. ..... 348/333.02
5,796,425 A 8/1998 Minami et al. ..... 348/181
5,856,844 A 1/1999 Batterman et al. ..... 348/207
5,920,398 A * 7/1999 Iwanaga et al. ..... 356/401

FOREIGN PATENT DOCUMENTS

| | | |
|---|---|---|
| JP | A 5-30544 | 2/1993 |
| JP | A 6-35607 | 2/1994 |
| JP | A 7-121293 | 5/1995 |
| JP | A 8-317432 | 11/1996 |
| JP | A 11-184445 | 7/1999 |
| JP | A 11-319316 | 11/1999 |

* cited by examiner

*Primary Examiner*—Daniel Miriam
(74) *Attorney, Agent, or Firm*—Oliff & Berridge PLC

(57) ABSTRACT

A position detector displays a target on a given plane and adds a standard on the given plane in the vicinity of the target with the location of the standard known. An image of the given plane is formed on an image plane of an image sensor with an image of the standard included, a point in the image of the given plane which is formed at a predetermined position of the image plane corresponding to the point to be detected. An image processor identifies the image of the standard on the image plane to calculate the position of the point to be detected. The standard includes asymmetric pattern. The standard includes a first standard and a second standard sequentially added on the given plane, the difference being calculated accompanied with the plus sign or the minus sign. The image on the given plane is formed by means of a scanning, the image sensor reads out the sensed image upon the termination of at least one period of the scanning. The second standard is added upon the initiation of the scanning after the completion of reading out of the image of the first standard.

19 Claims, 22 Drawing Sheets

FIRST STANDARD IMAGE Kt1

SECOND STANDARD IMAGE Kt2

THE FIRST IMAGE SIGNAL
(=BACKGROUND IMAGESIGNAL + THE 1ST STANDARD IMAGE SIGNAL)

THE SECOND IMAGE SIGNAL
(=BACKGROUND IMAGE SIGNAL + THE 2ND IMAGE SIGNAL)

DEFFERENCE IMAGE SIGNAL OF MARKS

POSITION DETECTOR AND ATTITUDE DETECTOR

BACKGROUND OF THE INVENTION

This application is based upon and claims priority of Japanese Patent Applications No. 2001-081908 filed on Mar. 22, 2001 and No. 2001-102934 filed on Apr. 2, 2001, the contents being incorporated herein by reference.

1. Field of the Invention

The present invention relates to a position detector and an attitude detector.

2. Description of Related Art

In this field of the art, especially in a robot vision, game machine and pointing device, various methods of detecting a position on a screen have been proposed. The typical one of the methods detects the desired position on the basis of the image of a standard or marks on the screen taken by a camera.

Examples of the above position detector are disclosed in Japanese Patent Publication Nos. Hei 6-35607, Hei 7-121293 and Hei 11-319316.

Also, a system for adjusting a video projector has been well known, in which a video camera captures a test pattern image displayed on a screen. However, if the video projector and the video camera have different vertical scanning frequencies from each other, a flickering pattern of bright and dark bands would be caused in the image taken by the video camera. In order to solve the problem, various proposals have been made, such as in Japanese Patent Publication Nos. Hei 5-30544, Hei 8-317432 and Hei 11-184445.

For example, Japanese Patent Publication No. Hei 11-184445 discloses an imaging system in which the timing of the start and the end of photographing in a video camera is controlled by generating a shutter control signal in accordance with the vertical synchronizing signal of a display apparatus.

However, there have been problems and disadvantages still left in the related arts, especially as to the convenience, accuracy or quickness of the detection.

SUMMARY OF THE INVENTION

In order to overcome the problems and disadvantages, the invention provides a position detector for detecting a position on a given plane. The position detector comprises a first controller for displaying a target point on the given plane and a second controller for displaying a known standard on the given plane in the vicinity of the target point with the location of the standard being known. The position detector further comprises an image sensor having an image plane on which an image that includes an image of the standard is formed, the image plane having a predetermined position. Also in the position detector according to the present invention, an image processor identifies the image of the standard on the image plane, and a processor calculates a position of a point on the given plane corresponding to the predetermined position on the image plane using parameters of an attitude of the image plane relative to the given plane based on the identified image of the standard.

Thus, the known standard can always be sensed on the image plane of the image sensor as long as the target point is aimed at even if the field angle of the image sensor is not so wide.

The above advantage is typical in accordance with a detailed feature of the present invention. In the detailed feature, the first controller displays the target point at different positions on the given plane, and the second controller displays the known standard at different positions on the given plane in correspondence to the different positions of the target point. Alternatively, the first controller displays one of different target points on the given plane, and the second controller displays the known standard in the vicinity of the one of the different target points on the given plane. Thus, the known standard always keeps up with the target no matter where the aimed target point is located or moved on the given plane.

According to another feature of the present invention, the known standard includes an asymmetric pattern. For example, the asymmetric pattern includes four marks forming a rectangle, one of the four marks being distinguishable from the others. This makes it possible to determine the rotary attitude of the image plane of the image sensor relative to the given plane.

According to still another feature of the present invention, the known standard includes a first standard and a second standard sequentially displayed on the given plane, wherein the image sensor senses a first image that includes an image of the first standard and a second image that includes an image of the second standard, and wherein the processor includes a calculator that calculates the difference between the first image and the second image to identify the image of the standard. In more detail, the processor determines whether the difference is positive or negative at the identified standard.

According to a further feature of the present invention the first standard and the second standard include a plurality of marks, respectively, the marks of the second standard being located at the same positions as the marks of the first standard with the pattern formed by the marks in the second standard being a reversal of that in the first standard.

The above features give the standard a high advantage in the detection thereof as well as the realization of its asymmetry.

According to another feature of the present invention, the first controller forms an image by scanning the given plane, the target point is displayed as a part of the image formed by the scanning, and the second controller displays the known standard as a part of the image formed by the scanning.

In more detail, the image sensor reads out the sensed image upon the termination of at least one period of the scanning.

According to another detailed feature the known standard includes the first standard and the second standard sequentially displayed on the given plane, the second controller starts displaying the second standard upon the initiation of the scanning after the image sensor completes the reading out of the sensed image that includes the first standard.

The above features are advantageous for the image sensor to sense the image on the given plane in synchronism with the scanning of the given plane by the first controller.

The above features and advantages according to the present invention are not only applicable to the position detector, but also to an attitude detector in its essence. Further, the above features and advantages relating to synchronization of the function of the image sensor with the scanning of the given plane is not only applicable to the position detector or the attitude detector, but also to a detector in general for detecting a standard on a given plane in its essence.

Other features and advantages according to the invention will be readily understood from the detailed description of the preferred embodiment in conjunction with the accompanying drawings.

DETAILED DESCRIPTION OF THE PREFERRED EMBODIMENT

[First Embodiment]

Figure 1:
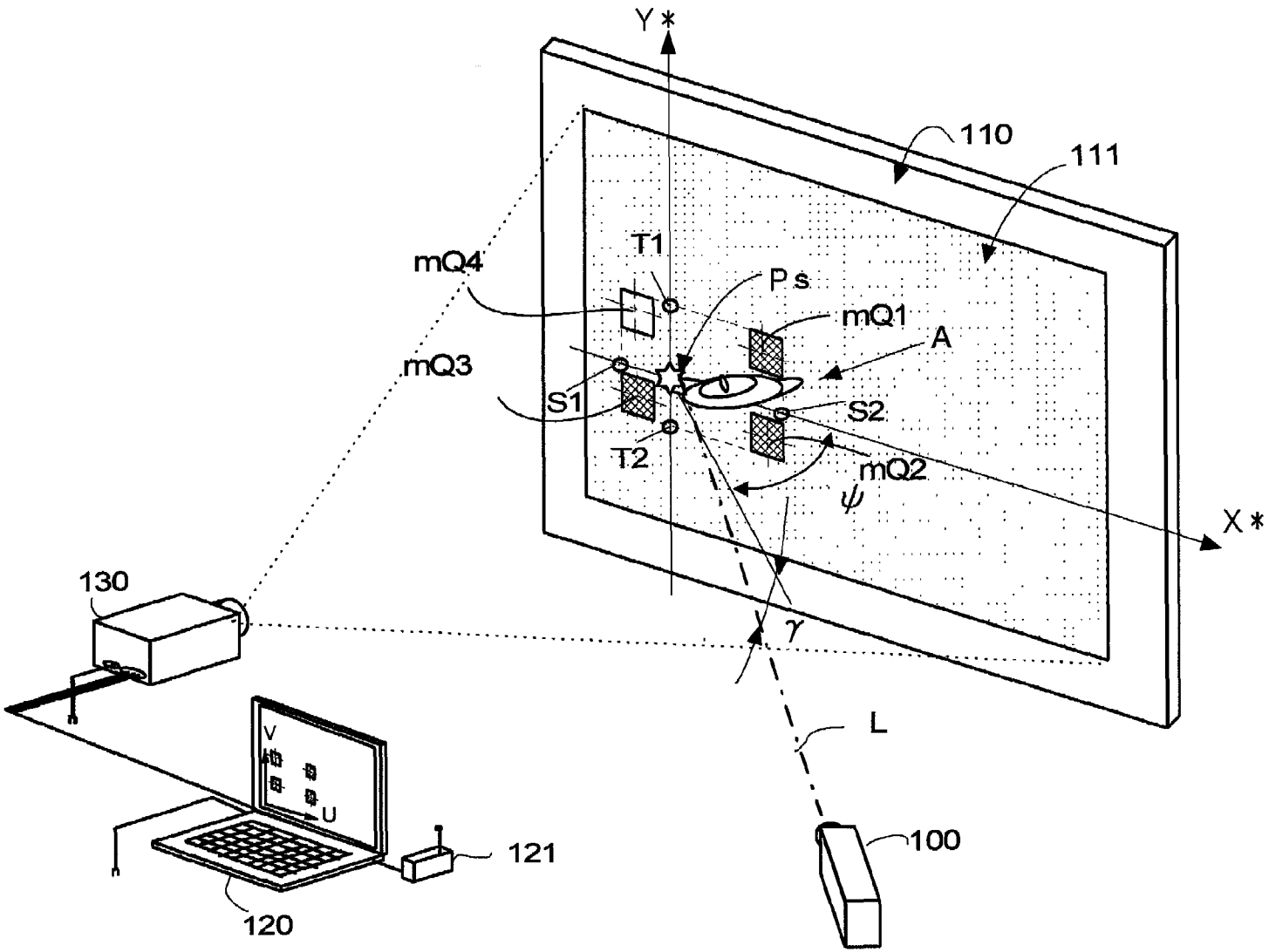
FIG. 1 represents a perspective view of the first embodiment of a shooting game machine.

FIG. 1 represents a perspective view of the first embodiment of a shooting game machine on the basis of the position and attitude detecting system according to the present invention. Projector 130 projects on wide screen 110 a scene according to the shooting game story.

Projected scene 111 includes target object A, which is a flying object, as well as a standard image including four detection marks mQ1, mQ2, mQ3, mQ4 surrounding target object A, the positions of the detection marks relative to target object A being predetermined in the projected scene 111. The player at point PS in front of wide screen 110 is to shoot the target object A at a predetermined point Ps with controller 100 formed as a gun, controller 100 serving as a sensor of the position and attitude detecting system.

In FIG. 1, the respective centers of gravity of the four marks are defined as characteristic points mQ1, mQ2, mQ3 and mQ4, which in combination form a rectangular. The position of image on the screen is identified with X*-Y* coordinate named "screen coordinate" with its origin at predetermined point Ps.

Though four detection marks are adopted as the standard image in the above embodiment, any alternative may be adopted as the standard as long as it can define a rectangle.

Figure 2:
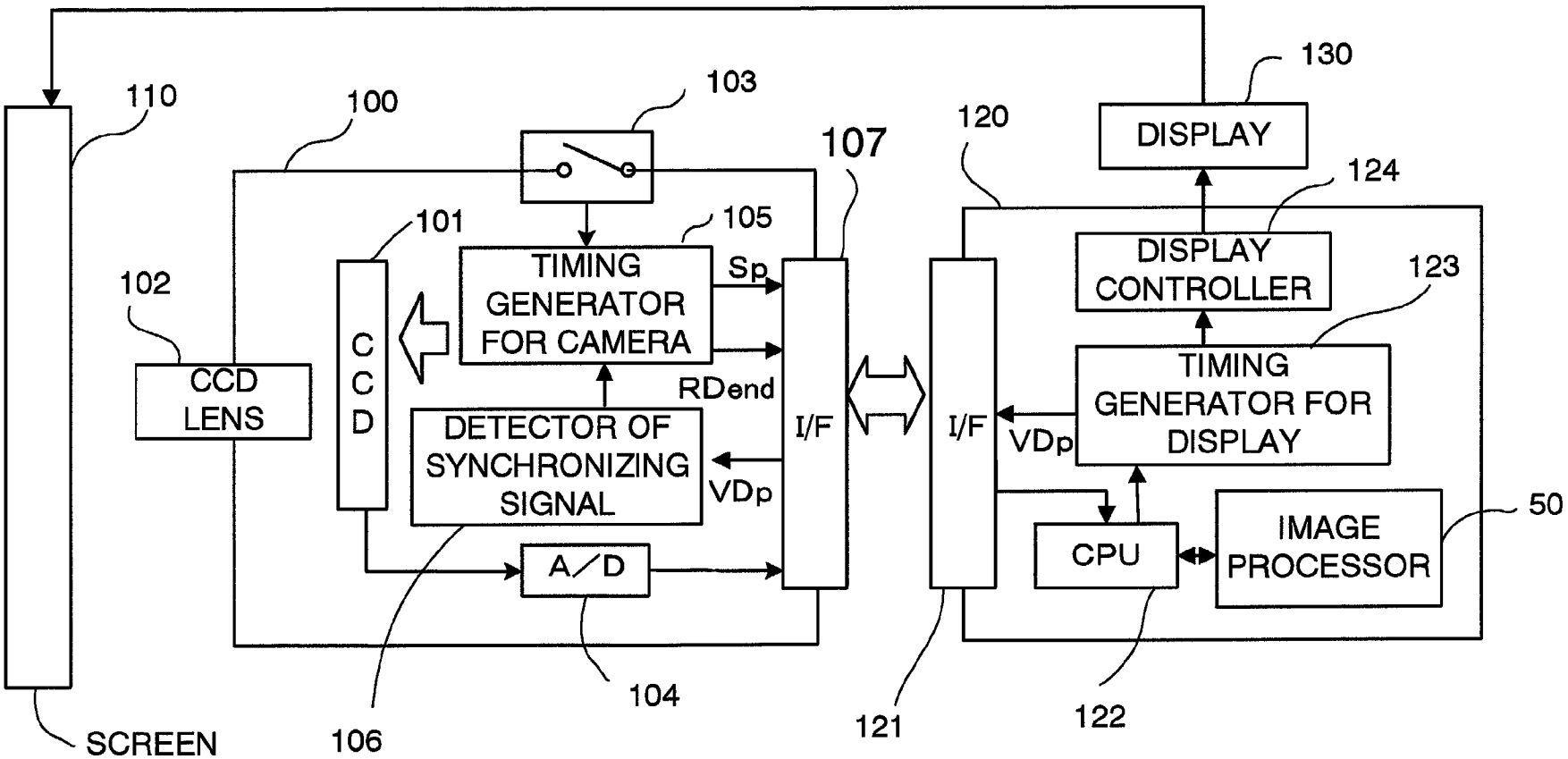
FIG. 2 represents a block diagram of the embodiment according to the present invention.

FIG. 2 represents a block diagram of the embodiment according to the present invention, in which the manner of sensing image is explained.

Controller 100 includes objective lens 102, image sensor 101 such as CCD (hereinafter referred to as CCD 101), trigger switch 103 for the player to take the picture on CCD 101 upon shooting the target, A/D converter 104 for converting the output of CCD 101 into digital image data, timing generator 105 for generating various clock signals necessary for CCD 101 to sense the image, synchronization signal detector 106 for picking up only the vertical synchronization signals among image signals transmitted to the image projector, and interface 107 for communicating with main body 120 of the game machine (or the personal computer). Though controller 100 also includes other conventional elements, such as power source, they are omitted from FIG. 2 for simplification.

The image signal taken by controller 100 is output from interface 107 for transmission to interface 121 of main body 120. As interface 107 and 121, various wired or wireless means may be adopted, such as USB, IEEE1294, IrDA or Bluetooth or the like. If main body 120 is provided with the conventional video board within the housing, the analog signal generated by CCD 101 may be directly input into main body 120 since such a video board normally includes an A/D converter.

Main body 120 includes timing generator 123 for synchronization with image signal, display controller 124 for controlling the video signal on display, and image processor 50, which processes image according to a predetermined program. Image processor according to the embodiment carries out the extraction of the four marks and necessary calculations thereon for detecting the position of target object.

Display controller 124 outputs video signal to projector 130 at the same cycle as the vertical synchronization signals generated by timing generator 123.

Synchronizing signal detector 106 located within controller 100 in the embodiment may be modified to locate within main body 120.

The display according to the embodiment, in which projector 130 projects image on wide screen 110, may modified to be replaced by a cathode ray tube (CRT) display, a liquid crystal device (LCD) display, or the like.

Figure 3:
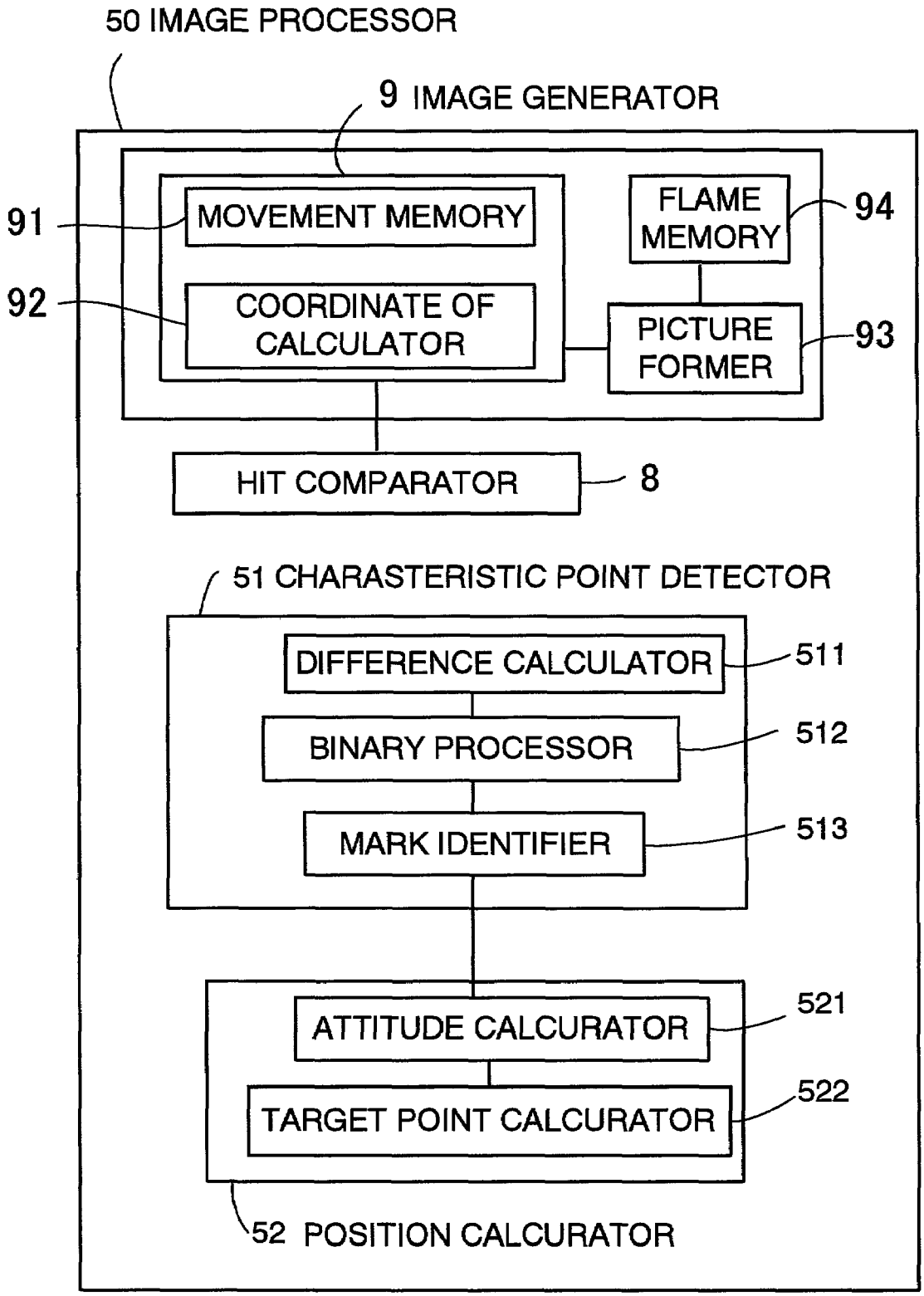
FIG. 3 represents a detailed block diagram of image processor 50.

FIG. 3 represents a detailed block diagram of image processor 50.

In FIG. 3, image processor 50 includes characteristic point detector 51, position calculator 6 and image generator 9.

Characteristic point detector 51 includes difference calculator 511 for extracting marks characterizing a rectangle on the basis of a difference between a pair of standard images of different illumination. Characteristic point detector 51 also includes a binary processor 512.

Mark identifier 513 is for calculating the coordinate of the center of gravity of each mark and distinguishes a mark from the others.

Position calculator 52 includes attitude calculator 521 for calculating the attitude of the wide screen relative to controller 100 and target point calculator 522 for calculating the coordinate of the target object.

Hit comparator 8 judges whether or not one of the objects is shot in one of its portions by means of comparing the position of each portion in each object with the position calculated by coordinate calculator 522. Hit comparator 8 is informed of positions of all portions in all objects to identify the shot object with its specific portion.

Image generator 9 superimposes the relevant objects on the background virtual reality space for display on screen 110 by projector 130. In more detail, image generator 9 includes movement memory 91 for storing a movement data predetermined for each portion of each object, the movement data being to realize a predetermined movement for any object if it is shot in any portion. Further included in image generator 9 is coordinate calculator 92 for converting a movement data selected from movement memory 91 into a screen coordinate through the perspective projection conversion viewed from an image view point, i.e. an imaginary camera view point, along the direction defined by angles $\alpha$, $\gamma$ and $\psi$. Image generator superimposes the calculated screen coordinate on the data of the background virtual reality space by means of picture former 93, the superimposed data thus obtained being stored in frame memory 94.

Picture former 93 controls the picture formation of the objects and the background virtual reality space in accordance with the advance of the game. For example, a new object will appear in the screen or an existing object will move within the screen in accordance with the advance of the game.

The superimposed data of objects and the background virtual reality space temporarily stored in frame memory 94 is combined with the scroll data to form a final frame image data to be projected on screen 110 by projector 130.

Figure 4:
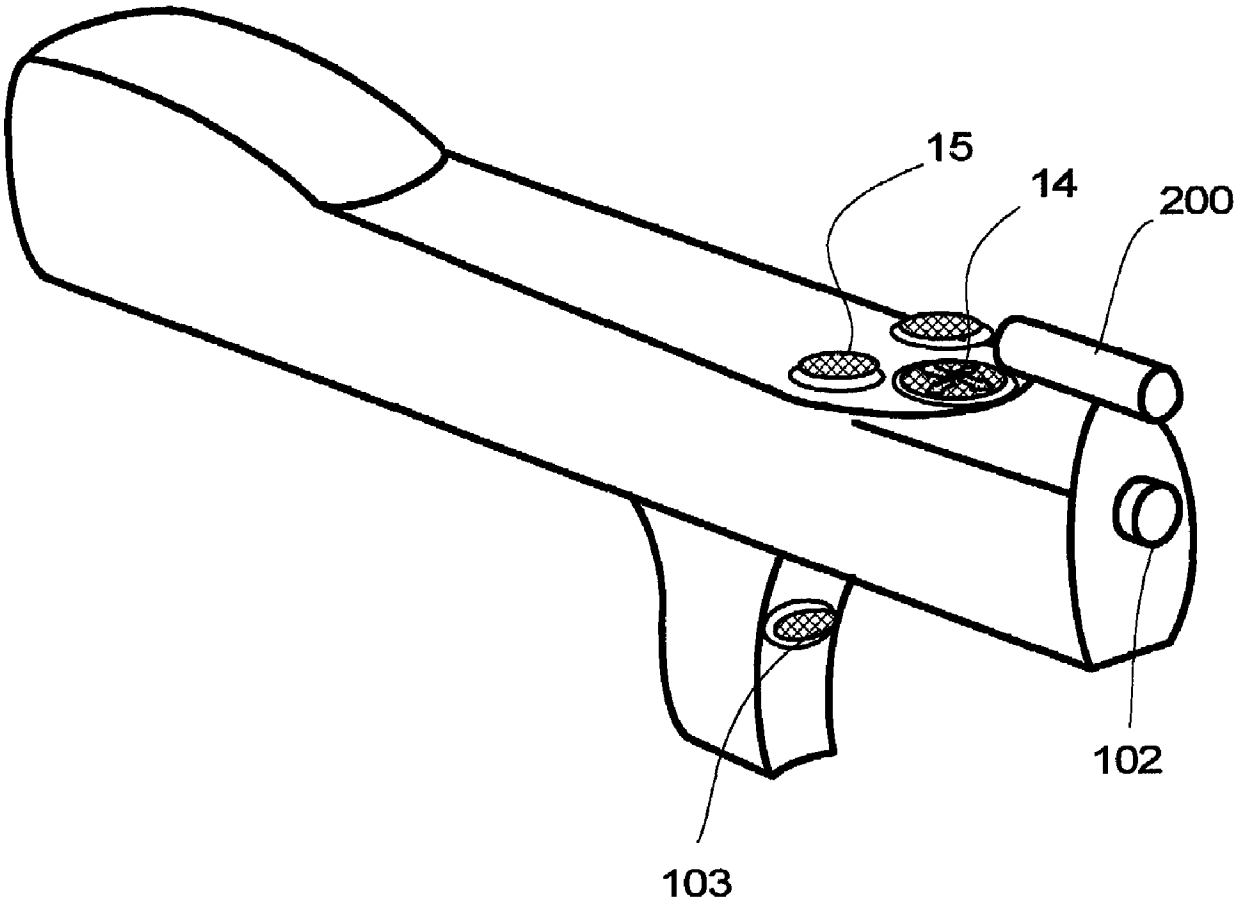
FIG. 4 represents a perspective view of controller 100.

FIG. 4 represents a perspective view of controller 100.

In FIG. 4, the controller 100 has the shutter release button 103 of a camera 100 to be transmitted toward the target for visually pointing the target point on the screen plane. The sighting device 200 is the light beam emitter or the optical finder for the purpose of aiming the target point so that the target point is sensed at the predetermined point on the image sensing plane of CCD 101.

Controller 100 further has control buttons 14, 15 to have an object character jump or go up and down, or backward and forward, which is necessary for advancing the game. Input/output interface 3 processes the image data by A/D converter, and transfers the result to image processor.

Figure 5:
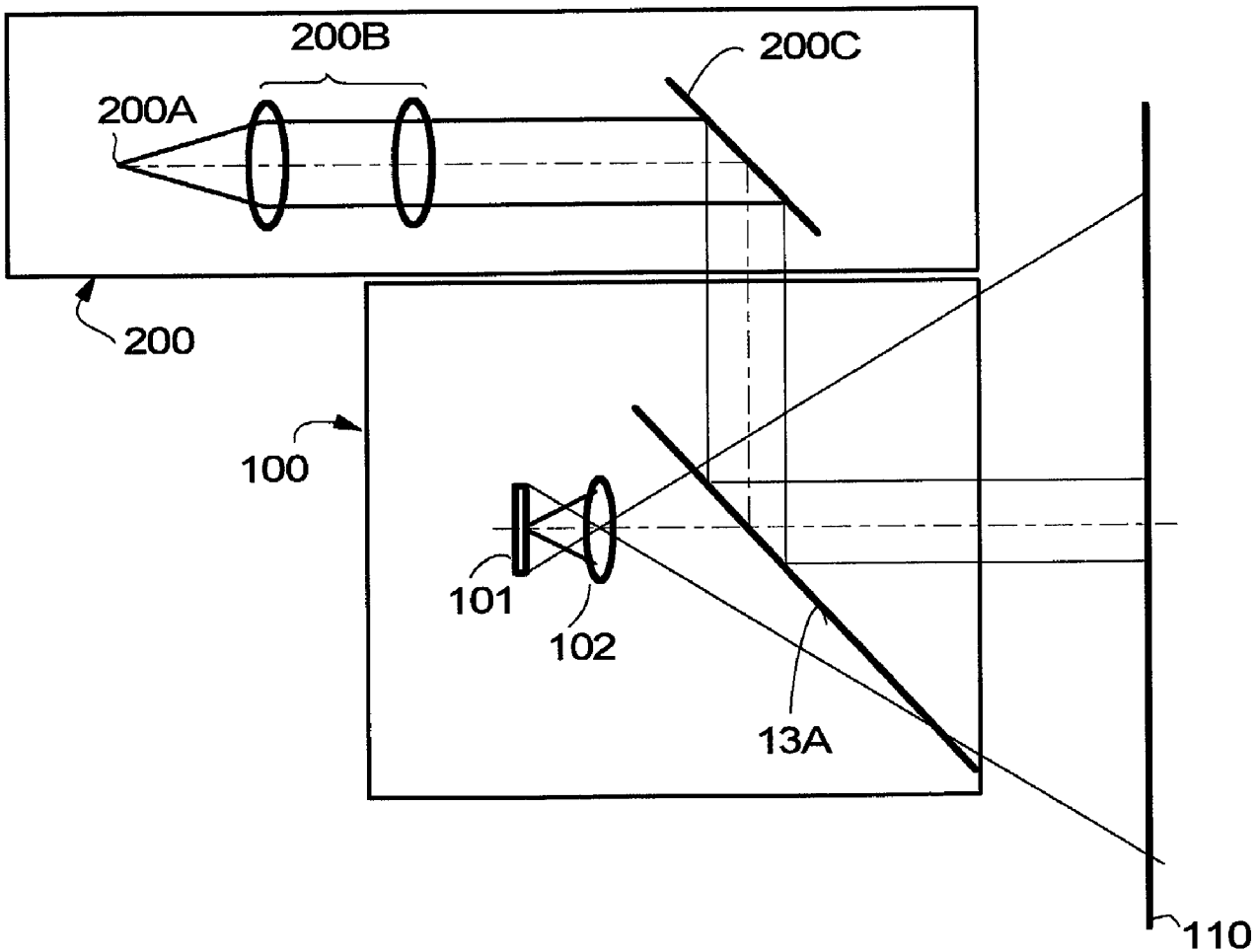
FIG. 5 represents a cross sectional view of the optical system in the controller 100.

FIG. 5 represents a cross sectional view of the optical system in the controller 100 using the light beam emitter as the sighting device 200. If a power switch is made on, the laser beam is emitted at light source point 200A and collimated by collimator 200B to advance on the optical axis of camera lens 102 toward rectangular plane 110 by way of mirror 200C and semitransparent mirror 13A. Camera 100 includes objective lens 102 and CCD 101 for sensing image through semitransparent mirror 13A, the power switch of the laser being made off when the image is sensed by camera 100. Therefore, mirror 13A may alternatively be a full refractive mirror, which is retractable from the optical axis when the image is sensed by camera 100.

The followings will give the explanation of the manner of detecting the position and attitude.

(a) Position Calculation

Position calculator calculates a coordinate of a target point Ps on a screen plane defined by characteristic points, the screen plane being located in a space.

Figure 6:
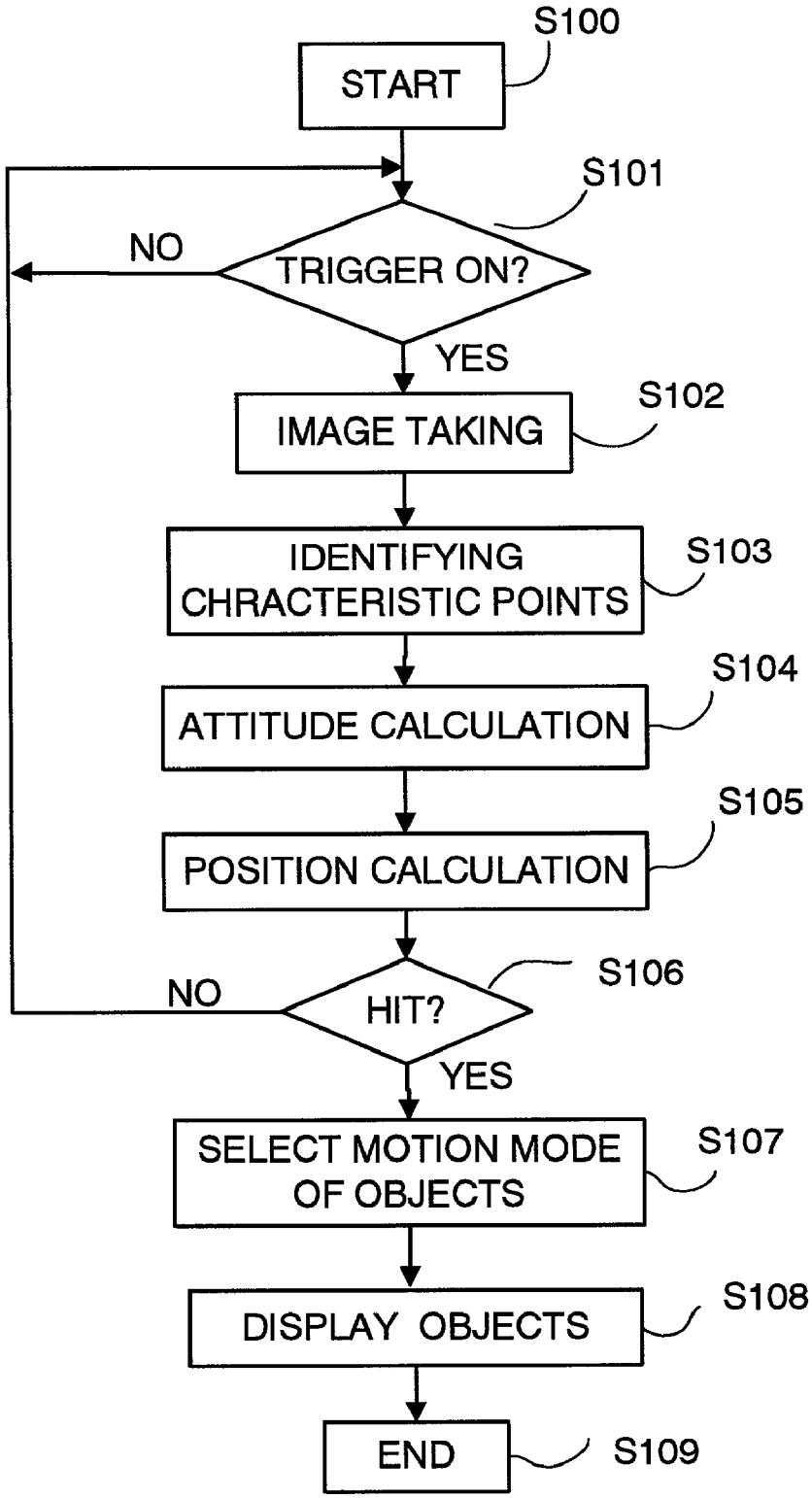
FIG. 6 represents a flowchart of the basic operation of the shooting game according to the present invention.

FIG. 6 represents a flowchart of the basic operation of the shooting game according to the present invention.

In step S100, the main power of the controller is turned on. In step S101, the target point on a screen plane having the plurality of characteristic points is aimed so that the target point is sensed at the predetermined point on the image sensing plane of CCD 101. According to the first embodiment, the predetermined point is specifically the center of image sensing plane of CCD 101 at which the optical axis of the objective lens 102 of camera intersects.

In step S102, the image is taken in response to shutter switch (trigger switch) 103 of the camera 100 with the image of the target point at the predetermined point on the image sensing plane of CCD 101.

In step S103, the characteristic points defining the rectangular plane are identified each of the characteristic points being the center of gravity of each of predetermined marks, respectively. The characteristic points are represented by coordinate q1, q2, q3 and q4 on the basis of image sensing plane coordinate.

Step S104 is for processing the rotational parameters for defining the attitude of the screen plane in a space relative to the image sensing plane, and step S105 is calculating the coordinate of the target point on the screen plane, which will be explained later in detail.

In step S106, the coordinate of position of the target point is compared with the coordinate of position calculated in step S105 to find whether the distance from the position calculated by the processor to the position of the target point is less than a limit. In other words it is judged in step S106 whether or not one of the objects is shot in one of its portions. If no object is shot in any of its portions in step S106, the flow returns to step S101 to wait for next trigger by the player since it is shown in step 106 that the player fails in shooting the object.

If it is judged in step 106 that one of the objects is shot in one of its portions, the flow advances to step S107, where a predetermined movement is selected in response to the identified shot portion. In more detail, in step S107, the movement data predetermined for the shot portion is retrieved from movement memory 91 to realize the movement for the shot portion. If such movement data includes a plurality of polygon data for a three-dimensional object, a movement with high reality of the object is realized by means of selecting the polygon data in accordance with the attitude calculated in step S104.

In step S108 the data of movement of the target given through step S109 is combined with the data of position and direction of the player given through step for forming a final image to be displayed on screen 110 by projector 130. The data of position of the player will give a high reality of the change in the target and the background space on screen 110 in accordance with the movement of the player relative to screen 110.

Figure 7:
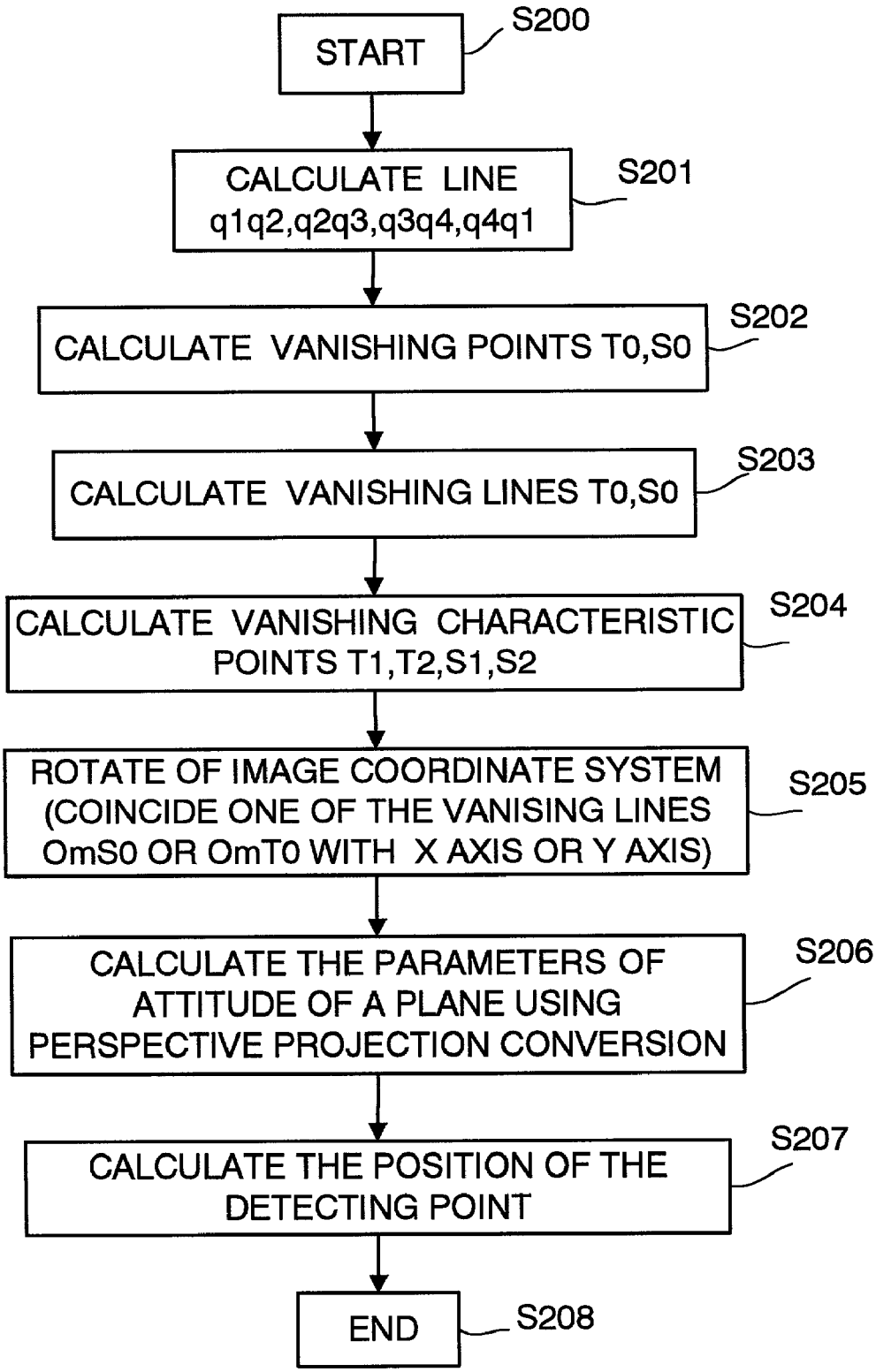
FIG. 7 shows the manner of calculating the coordinate of the target point.

FIG. 7 shows the manner of calculating the coordinate of the target point and corresponds to the details of step 105 in FIG. 6.

Figure 8:
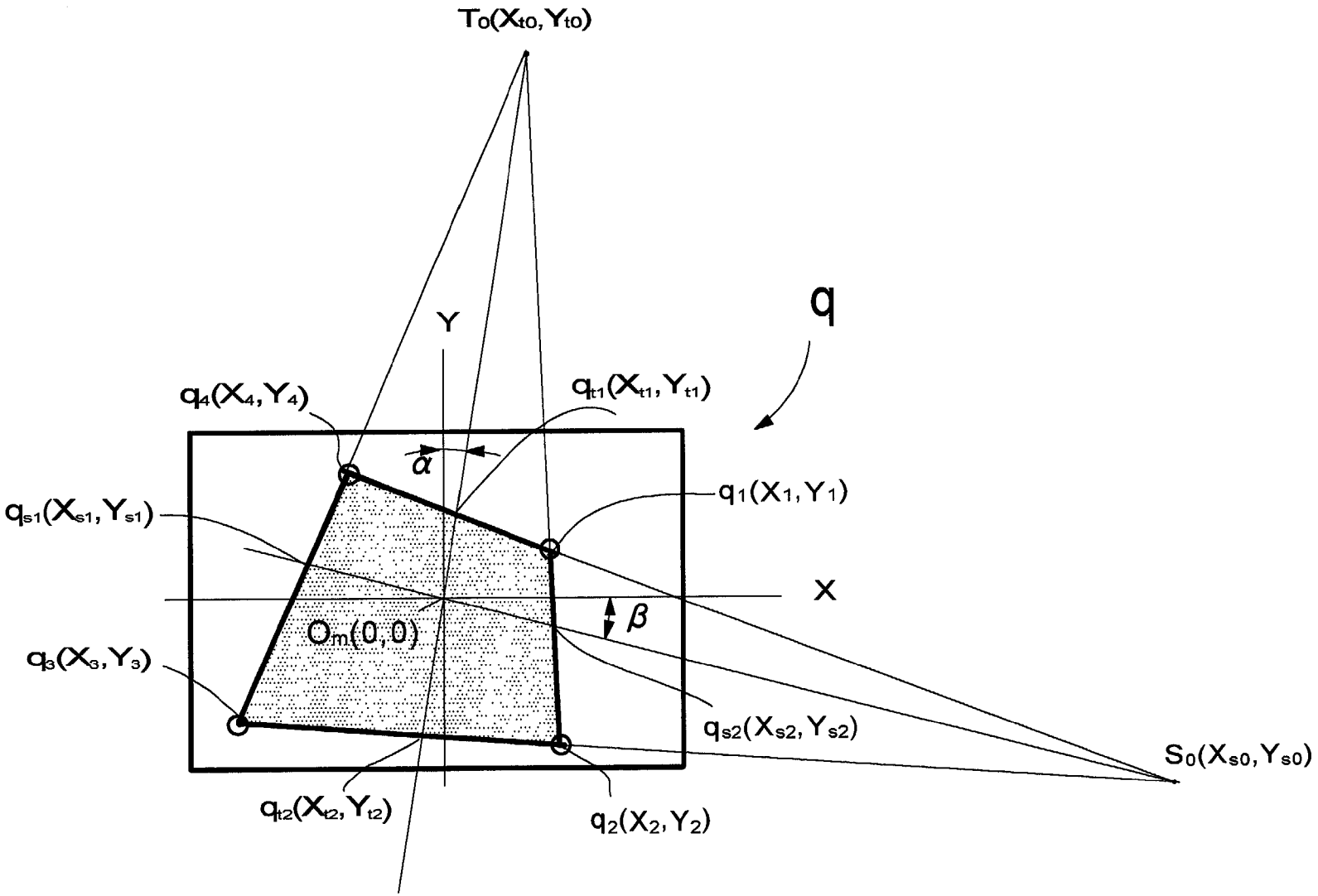
FIG. 8 represents the image q taken by the controller 100.

FIG. 8 represents the image q taken by the controller 100. In FIG. 8 image of target point Ps is in coincidence with predetermined point Om, which is the origin of the image coordinate. Characteristic points q1, q2, q3 and q4 are the images on the image sensing plane of the original of characteristic points mQ1, mQ2, mQ3 and mQ4 on the rectangular plane represented by X*-Y* coordinate.

(a1) Attitude Calculation

Now, the attitude calculation, which is the first step of position calculation, is to be explained in conjugation with the flow chart in FIG. 7.

The parameters for defining the attitude of the given plane with respect to the image sensing plane are rotation angle $\gamma$ around X-axis, rotation angle $\psi$ around Y-axis, and rotation angle $\alpha$ or $\beta$ around Z-axis.

Referring to FIG. 7, linear equations for lines q1q2, q2q3, q3q4 and q4q1 are calculated on the basis of coordinates for detected characteristic points q1, q2, q3 and q4 in step S201, lines q1q2, q2q3, q3q4 and q4q1 being defined between neighboring pairs among characteristic points q1, q2, q3 and q4, respectively. In step S202, vanishing points T0 and S0 are calculated on the basis of the liner equations.

The vanishing points defined above exist in the image without fail if a rectangular plane is taken by a camera. The vanishing point is a converging point of lines. If lines q1q2 and q3q4 are completely parallel with each other, the vanishing point exists in infinity.

According to the first embodiment, the plane located in a space is a rectangular having two pairs of parallel lines, which cause two vanishing points on the image sensing plane, one vanishing point approximately on the direction along the X-axis, and the other along the Y-axis.

In FIG. 8, the vanishing point approximately on the direction along the X-axis is denoted with S0, and the other along the Y-axis with T0. Vanishing point T0 is an intersection of lines q1q2 and q3q4.

In step S203, linear vanishing lines OmS0 and OmT0, which are defined between vanishing points and origin Om, are calculated.

Further in step S203, vanishing characteristic points qs1, qs2, qt1 and qt2, which are intersections between vanishing lines OmS0 and OmT0 and lines q3q4, q1q2, q4q1 and q2q3, respectively, are calculated.

The coordinates of the vanishing characteristic points are denoted with qs1 (Xs1,Ys1), qs2 (Xs2,Ys2), qt1 (Xt1,Yt1) and qt2 (Xt2,Yt2). Line qt1qt2 and qs1qs2 defined between the vanishing characteristic points, respectively, will be called vanishing lines as well as OmS0 and OmT0.

Vanishing lines qt1qt2 and qs1qs2 are necessary to calculate target point Ps on the given rectangular plane. In other words, vanishing characteristic points qt1, qt2, qs1 and qs2 on the image coordinate (X-Y coordinate) correspond to points T1, T2, S1 and S2 on the plane coordinate (X*-Y* coordinate) in FIG. 1, respectively.

If the vanishing point is detected in infinity along X-axis of the image coordinate in step S202, the vanishing line is considered to be in parallel with X-axis.

Instep S204, image coordinate (X-Y coordinate) is converted into X'-Y' coordinate by rotating the coordinate by angle $\beta$ around origin Om so that X-axis coincides with vanishing line OmS0. Alternatively, image coordinate (X-Y coordinate) may be converted into X"-Y" coordinate by rotating the coordinate by angle $\alpha$ around origin Om so that Y-axis coincides with vanishing line OmT0. Only one of the coordinate conversions is necessary according to the first embodiment.

Figure 9:
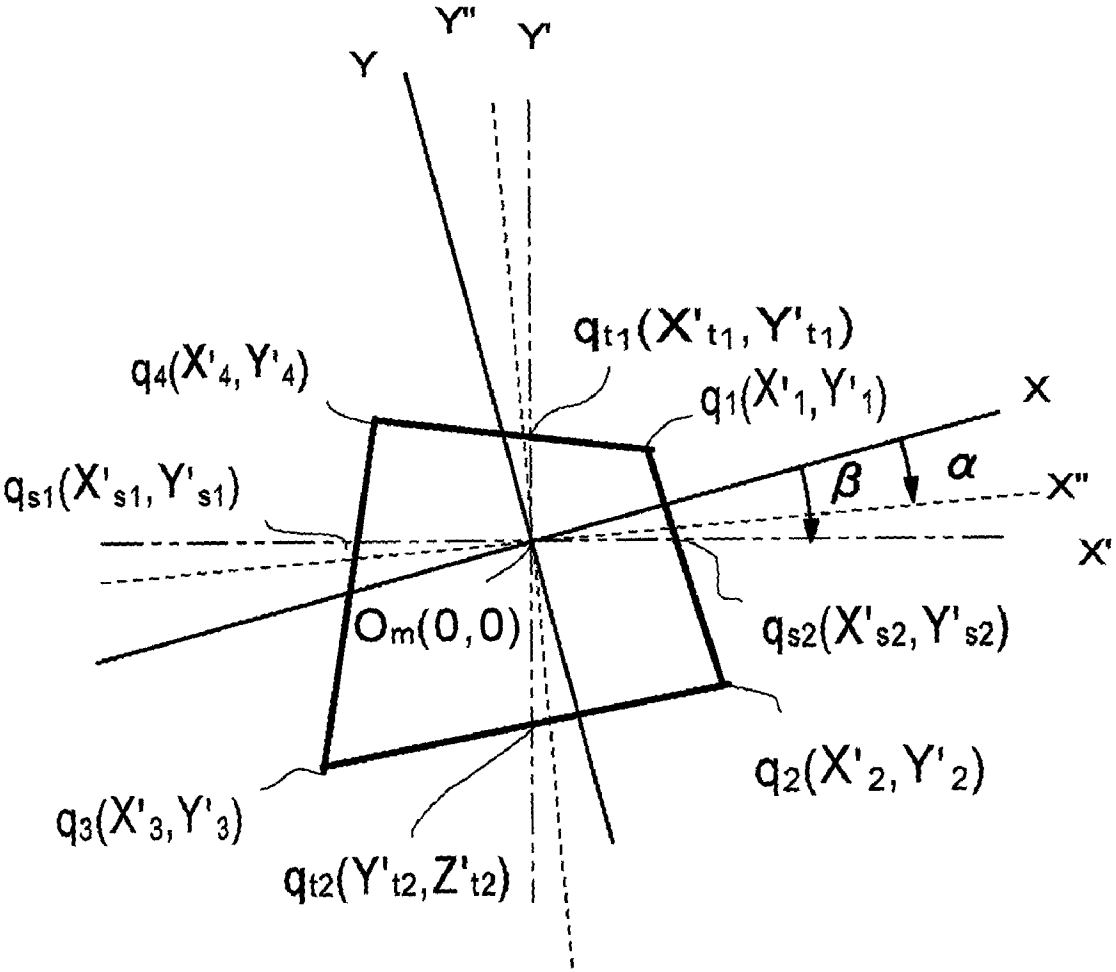
FIG. 9 is to explain the coordinate conversion.

FIG. 9 is to explain the coordinate conversion from X-Y coordinate to X'-Y' coordinate by rotation by angle $\beta$ around origin Om with the clockwise direction is positive. FIG. 9 also explains the alternative case of coordinate conversion from X-Y coordinate to X"-Y" coordinate by rotating the coordinate by angle $\alpha$.

The coordinate conversion corresponds to a rotation around Z-axis of a space (X-Y-Z coordinate) to determine one of the parameters defining the attitude of the given rectangular plane in the space.

By means of the coincidence of vanishing line qs1qs2 with X-axis, lines mQ1mQ2 and mQ3mQ4 are made in parallel with X-axis.

In step S205, characteristic points q1, q2, q3 and q4 and vanishing characteristic points qt1, qt2, qt3 and qt4 on the new image coordinate (X'-Y' coordinate) are related to characteristic points mQ1, mQ2, mQ3 and mQ4 and points T1, T2, S1 and S2 on the plane coordinate (X*-Y* coordinate). This is performed by perspective projection conversion according to the geometry. By means of the perspective projection conversion, the attitude of the given rectangular plane in the space (X-Y-Z coordinate) on the basis of the image sensing plane is calculated. In other words, the pair of parameters, angle $\psi$ around Y-axis and angle $\gamma$ around X-axis for defining the attitude of the given rectangular plane are calculated.

In step S206, the coordinate of target point Ps on the plane coordinate (X*-Y* coordinate) is calculated on the basis of the parameters gotten in step S205. The details of the calculation to get the coordinate of target point Ps will be discussed later in section (a2).

Perspective projection conversion is for calculating the parameters (angles $\psi$ and angle $\gamma$) for defining the attitude of the given rectangular plane relative to the image sensing plane on the basis of the four characteristic points identified on image coordinate (X-Y coordinate).

Figure 10:
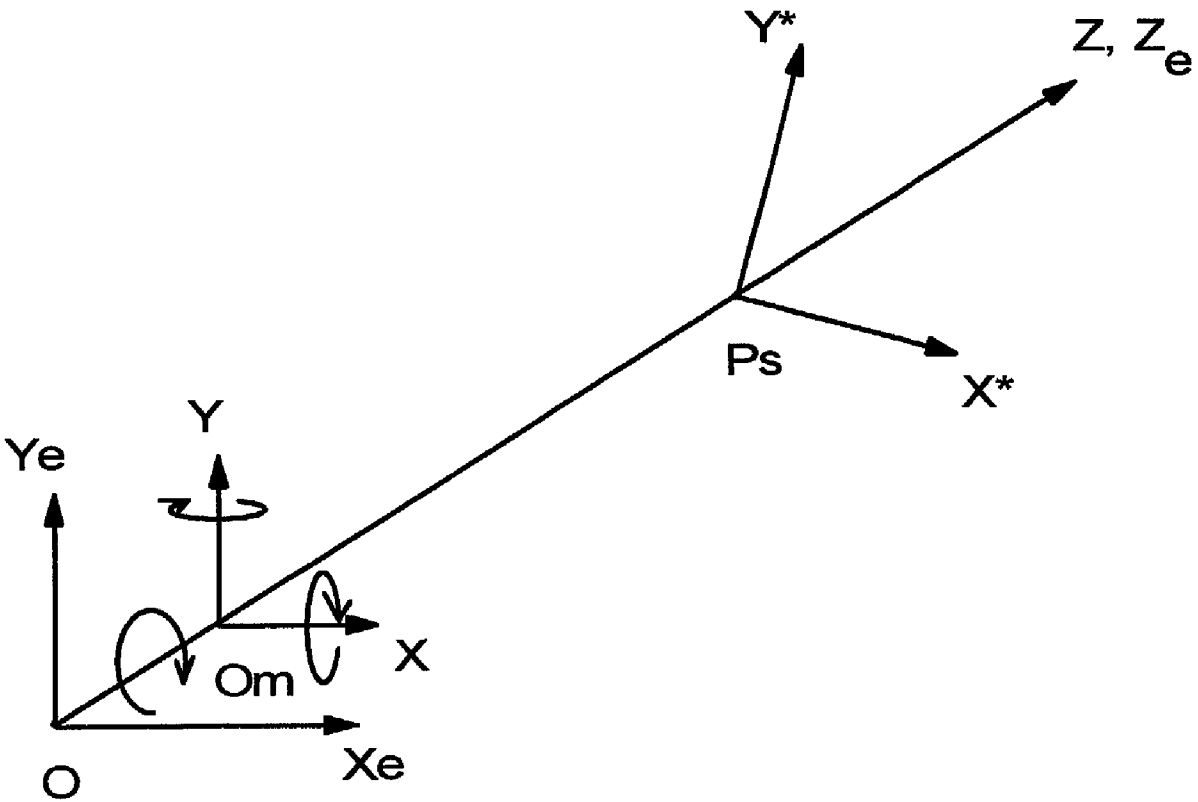
FIG. 10 is an explanation of the spatial relationship between X-Y-Z coordinate and X*-Y* coordinate.

FIG. 10 is an explanation of the spatial relationship between X-Y-Z coordinate (hereinafter referred to as "image coordinate") representing the equivalent image sensing plane in a space and X*-Y* coordinate (hereinafter referred to as "plane coordinate") representing the given rectangular plane. Z-axis of image coordinate intersects the center of the equivalent image sensing plain perpendicularly thereto and coincides with the optical axis of the objective lens. View point O for the perspective projection conversion is on Z-axis apart from origin Om of the image coordinate by f. Rotation angle $\gamma$ around X-axis, rotation angle $\psi$ around Y-axis, and two rotation angles $\alpha$ and $\beta$ both around Z-axis are defined with respect to the image coordinate, the clockwise direction being positive for all the rotation angles. With respect to view point O, Xe-Ye-Ze coordinate is set for perspective projection conversion, Ze-axis being coincident with Z-axis and Xe-axis and Ye-axis being in parallel with which will X-axis and Y-axis, respectively.

Equations (1) and (2) are conclusion of defining angle $\gamma$ an $\psi$ which are the other two of parameters for defining the attitude of the given rectangular plane relative to the image sensing plane. The value for tan $\gamma$ given by equation (1) can be practically calculated by replacing tan $\psi$ by the value calculated through equation (2). Thus,all of the three angles $\beta$, $\gamma$ and $\psi$ are obtainable.

$$\tan\gamma = -\frac{1}{\tan\phi}\cdot\frac{X'_{tl}}{Y'_{tl}} \tag{1}$$

$$\tan\phi = \frac{Y'_1 - Y'_{tl}}{X'_{tl}Y'_1 - X'_1 - Y'_{tl}}\cdot f \tag{2}$$

In the case of equations (1) and (2), at least one coordinate of characteristic point q1 (X'1, Y'1), at least one coordinate of a vanishing characteristic point qt1 (X't1, Y't1) and distance f are only necessary to get angles $\gamma$ and $\psi$.

(a2) Coordinate Calculation

Now, the coordinate calculation for determining the coordinate of the target point on the given rectangular plane is to be explained. The position of target point Ps on given rectangular plane 110 with the plane coordinate (X*-Y* coordinate) in FIG. 1 is calculated by coordinate calculator 522 in FIG. 3 on the basis of the parameters for defining the attitude of the given rectangular plane obtained by attitude calculator 521.

The coordinate of the target point Ps on the given rectangular plane can be expressed as in the following equation (3) using ratio m=OmS1/OmS2 and ratio n=OmT1/OmT2.

$$P_s(u, v) = \left(\frac{m}{m+1} \cdot U_{\max}, \frac{n}{n+1} \cdot V_{\max}\right) \tag{3}$$

$$m = \frac{\overline{O_m S_1}}{\overline{O_m S_2}} = \frac{|X'_{s1}|}{|X'_{s2}|} \cdot \frac{|X'_{s2} \cdot \tan\phi + f|}{|X'_{s1} \cdot \tan\phi + f|} \tag{4}$$

$$n = \frac{\overline{O_m T_1}}{\overline{O_m T_2}} = \frac{|X'_{t1}|}{|X'_{t2}|} \cdot \frac{|f \cdot \tan\phi - X'_{t2}|}{|f \cdot \tan\phi - X'_{t1}|} \tag{5}$$

(b) Characteristic Point Detection

The function of the characteristic point detector is as follows:

(b1) The Standard Image

According to the embodiment, the mark is extracted by means of the difference method, For the difference method, a pair of standard images of different illumination are prepared, the images being displayed according to the time sharing. In the embodiment, the pair of standard images consists of a first image and a second image both with four marks, the color of which differs between green in the first state and black in the second state.

FIG. 11 represents the pair of standard images Kt1 and Kt2 both with four marks.

Figure 11A:
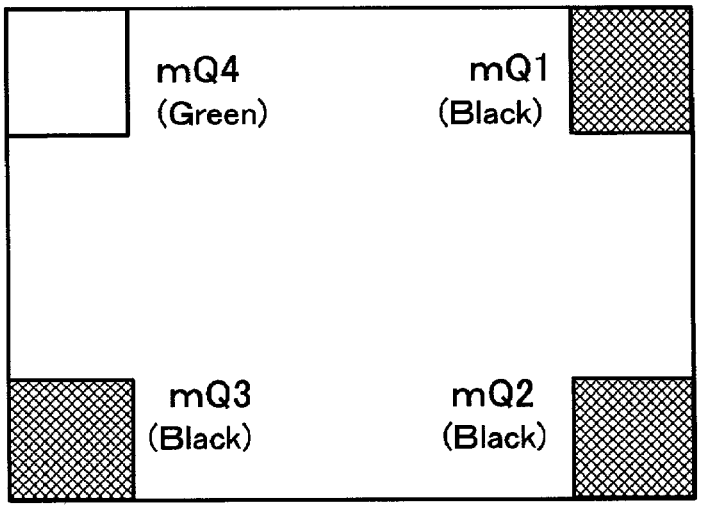
FIG. 11 represents the pair of standard images Kt1 and Kt2 both with four marks.
Figure 11B:
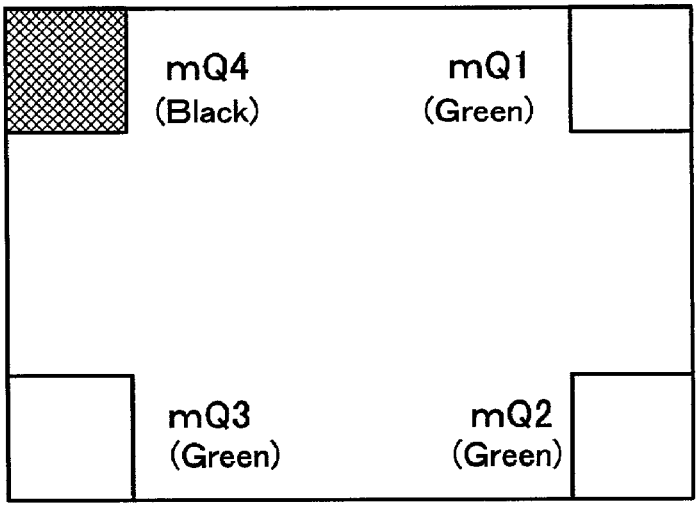

FIG. 11A represents first standard image Kt1, in which the upper-left mark is green in the first state and the others are black in the second state. On the other hand, FIG. 11B represents second standard image Kt2, in which the upper-left mark is black in the second state and the others are green in the first state. The relationship of the four marks is reversed between first standard image Kt1 and second standard image Kt2. Further, one of the marks is distinguishable from the other three, which causes an asymmetry color arrangement of the four marks.

The one mark of the color different from those of the other three marks makes it possible to determine the rotary attitude of the image plane of CCD 101 relative to wide screen 110. Further, only two colors, i.e., black and green, are used to represent all the marks in the pair of standard images, CCD 101 can easily extract the four marks without any difficulty of sensing a color difficult to detect, which removes conditions necessary for successful extraction of the marks.

(b2) Sensing of the Projected Standard Image

Figure 12:
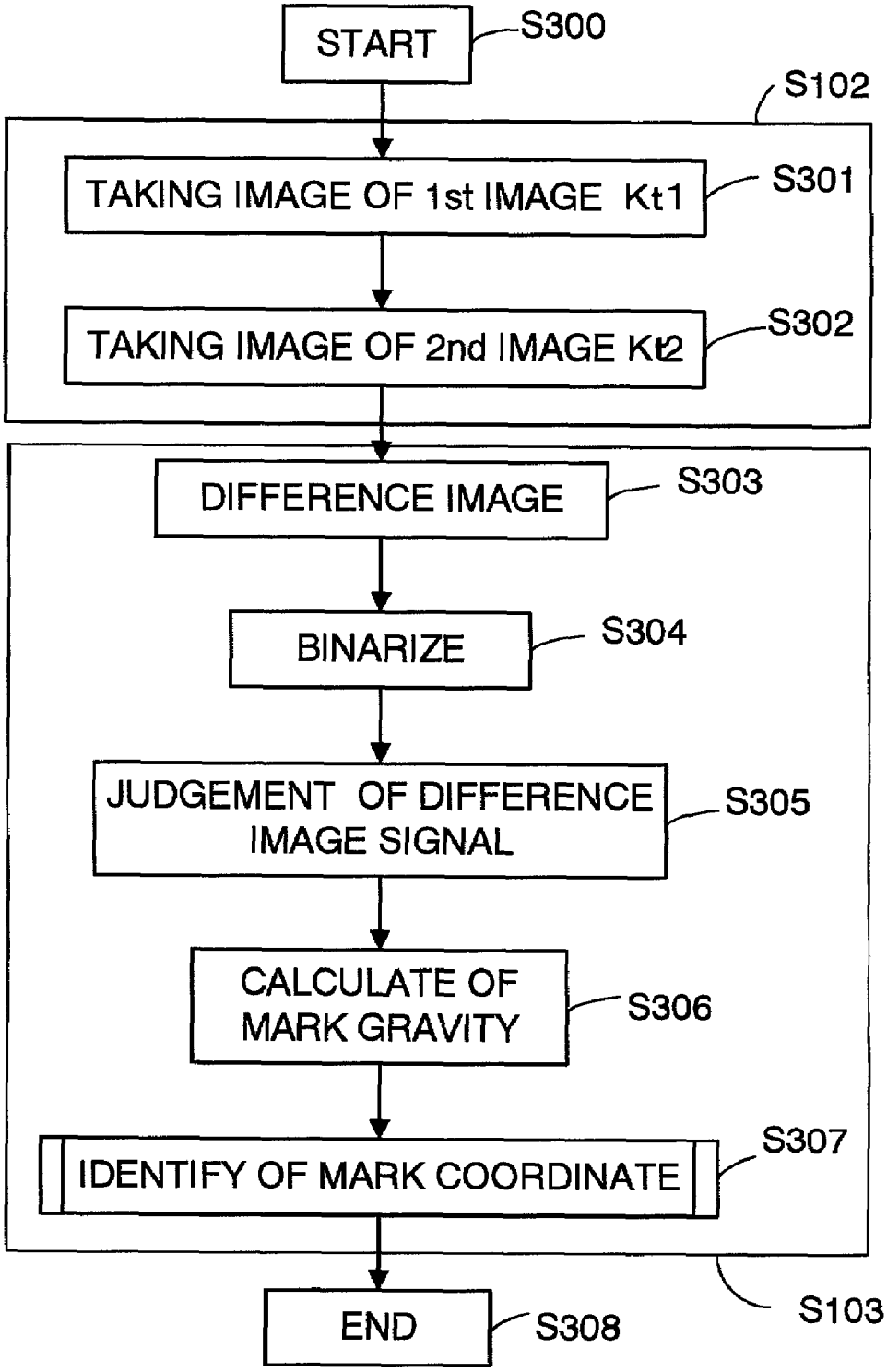
FIG. 12 represents a flowchart of the functions of sensing image

FIG. 12 represents a flowchart of the functions of sensing image to detecting the characteristic points. In the flowchart, steps S301 and S302 correspond to the sensing of the image projected on the wide screen. Steps S303 to S308 correspond to the difference calculation to the characteristic points detection, which will be referred to in subparagraph (b3).

The first standard image Kt1 is projected on the wide screen and sensed by the image sensor in step S301, while the second standard image Kt2 is projected on the wide screen and sensed by the image sensor in step S302.

As shown in FIG. 1, the target object is projected on the wide screen. If a player operates trigger switch 103 with controller 100 aimed at a specific portion of the target object, step S301 and step S302 are successively carried out to sense the four marks located at a predetermined position relative to the target object.

Figure 13:
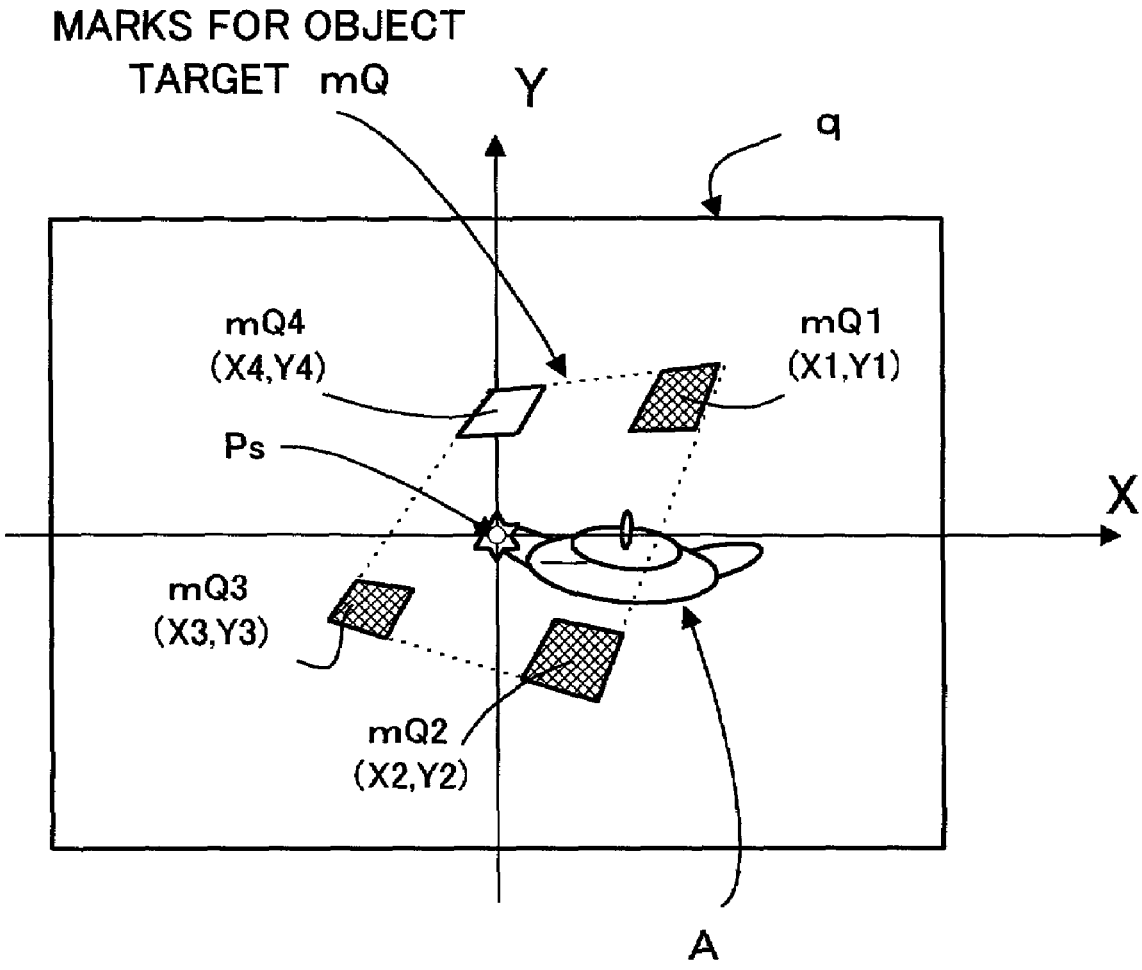
FIG. 13 represents sensed image q taken by CCD 101 of controller 100.

FIG. 13 represents sensed image q taken by CCD 101 of controller 100 located at point Ps in FIG. 1. Detected point Ps is set at the center of the sensed image, which is the origin of image coordinate X-Y and coincides with a specific point of the target object, e.g., a wing of the flying object, if the specific point is correctly aimed.

According to the embodiment, the marks are prepared and indicated at a predetermined position adjacent to the target object in conformity with the advance of game story.

Figure 14:
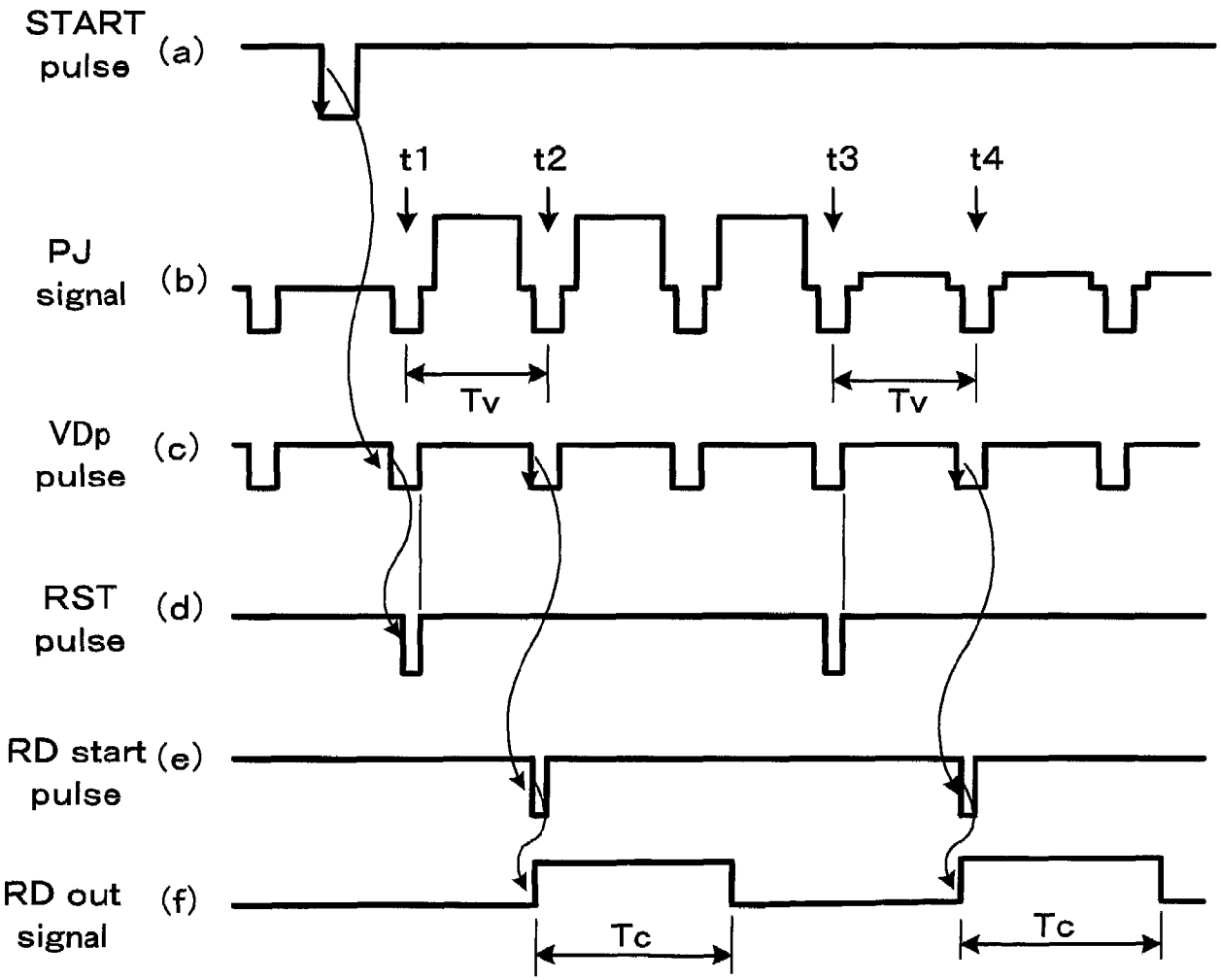
FIG. 14 represents timing charts of the function of controller 100 in sensing images.

FIG. 14 represents timing charts of the function of controller 100 in sensing images. FIG. 14(*a*) represents the timing of START pulse for starting the image sensing, which is generated when trigger switch 103 of controller 100 is operated by a player. START pulse is input into timing generator 105 and also into main body 120 through interfaces 107 and 121. FIG. 14(*b*) represents the timing of PJ signal, which is a composite video signal formed by adding vertical synchronization signals to the video signal transmitted from main body 120 to projector 130. FIG. 14(*c*) represents the timing of VDp signal, which is the vertical synchronization signal component extracted from the composite video signal transmitted from main body 120. Main body 120 transmits to projector 130 the video signal for projecting the first standard image during period Tv between t1 and t2 directly following the generation of START pulse.

FIG. 14(*d*) represents the timing of RST pulse, which is the reset pulse for CCD 101. Timing generator 105 generates and transmits RST pulse to CCD 101 at time t1 in synchronism with VDp signal. Following RST pulse, CCD 101 starts to sense the projected first standard image. FIG. 14(*e*) represents the timing of RD start pulse to start reading out the accumulated charge on CCD. Timing generator 105 generates RD start pulse at time t2 with period Tv passed after the transmission of RST pulse to CCD 101. RD start pulse causes RD out signal in FIG. 14(*f*) for reading out the accumulated charge on CCD 101, RD out signal going on for time Tc. Then main body 120 repeats to generate PJ signals for a period three times as long as Tv, which continues the projection of the first standard image until time t3. The projection of the first standard image by projector 130 is substituted by that of the second standard image at time t3, which starts with the first period Tv until time t4.

As in FIG. 14(*d*) on the other hand, timing generator 105 generates and transmits to CCD 101 RST pulse at time t3 to remove unnecessary charges. Then the charge on CCD 101 is read out during time Tc in FIG. 14(*f*) starting with time t4 when RD start pulse in FIG. 14(*e*) is generated in synchronism with VDp pulse in FIG. 14(*c*). The first standard image is not necessarily continued to be projected for a period three times as long as Tv, but to be projected for the first period Tv in a modified embodiment.

Figure 15:
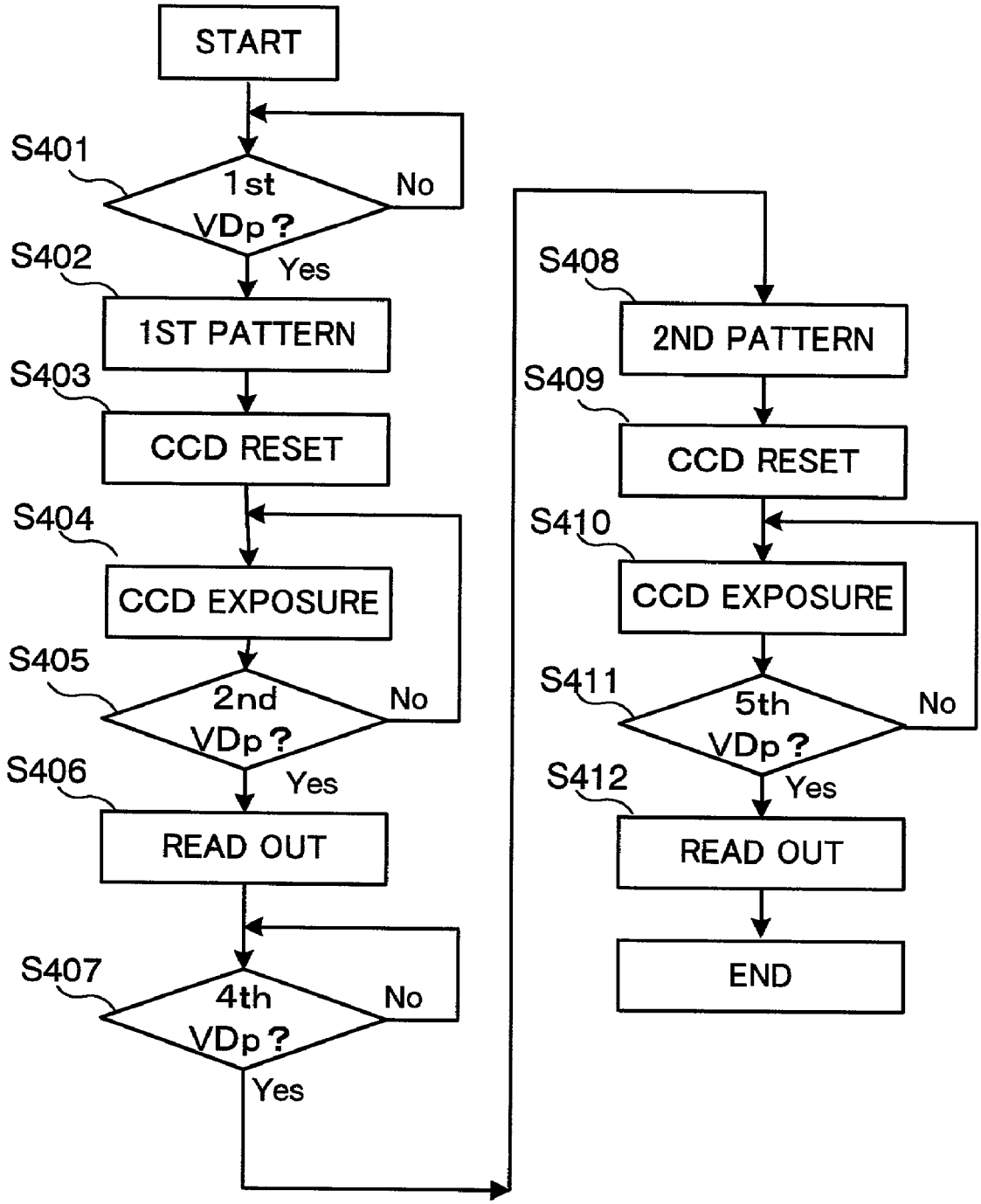
FIG. 15 represents a flowchart of the function of controller 100.

FIG. 15 represents a flowchart of the function of controller 100. The flow begins with the operation of trigger switch 103, which causes START pulse as in FIG. 14(*a*) to be transmitted to timing generator 105 and main body 120. Step S401 wait for a first VDp signal for the projection of the first standard image. When the first VDp signal comes at time t1, the flow advances to step S402, in which main body 120 transmits PJ signal to projector 130 for projecting the first standard image. In step S403, timing generator 105 generates and transmits RST pulse to CCD 101 for removing unnecessary charges. In step S404, CCD 101 is exposed to the first standard image. The exposure is continued until the generation of the second VDp signal is detected in step S405. In step S406, when the exposure time is over at time t2, timing generator 105 generates and transmits RD start pulse as in FIG. 14(*e*) to CCD 101, which causes the reading out of the charge on CCD 101 during period time Tc.

If it is detected that the fourth VDp signal comes at time t3 in step S407, the flow advances to step S408, in which main body 120 switches the projection of the first standard image into the second standard image. In step S409, timing generator 105 generates and transmits RST pulse to CCD 101. In step 410, CCD 101 is exposed to the second standard image. The exposure is continued until the generation of the fifth VDp signal is detected in step S411. In step S412, when the second exposure time is over at time t4, timing generator 105 generates and transmits RD start pulse as in FIG. 14(*e*) to CCD 101, which causes the reading out of the second standard image form CCD 101 during time Tc.

(b3) Difference Method and Characteristic Point Detection

Referring back to FIG. 12, difference method is carried out in steps S303 on the basis of difference between the first standard image gotten in step S301 and the second standard image gotten in step S302.

Figures 16A, 16B, 16C:
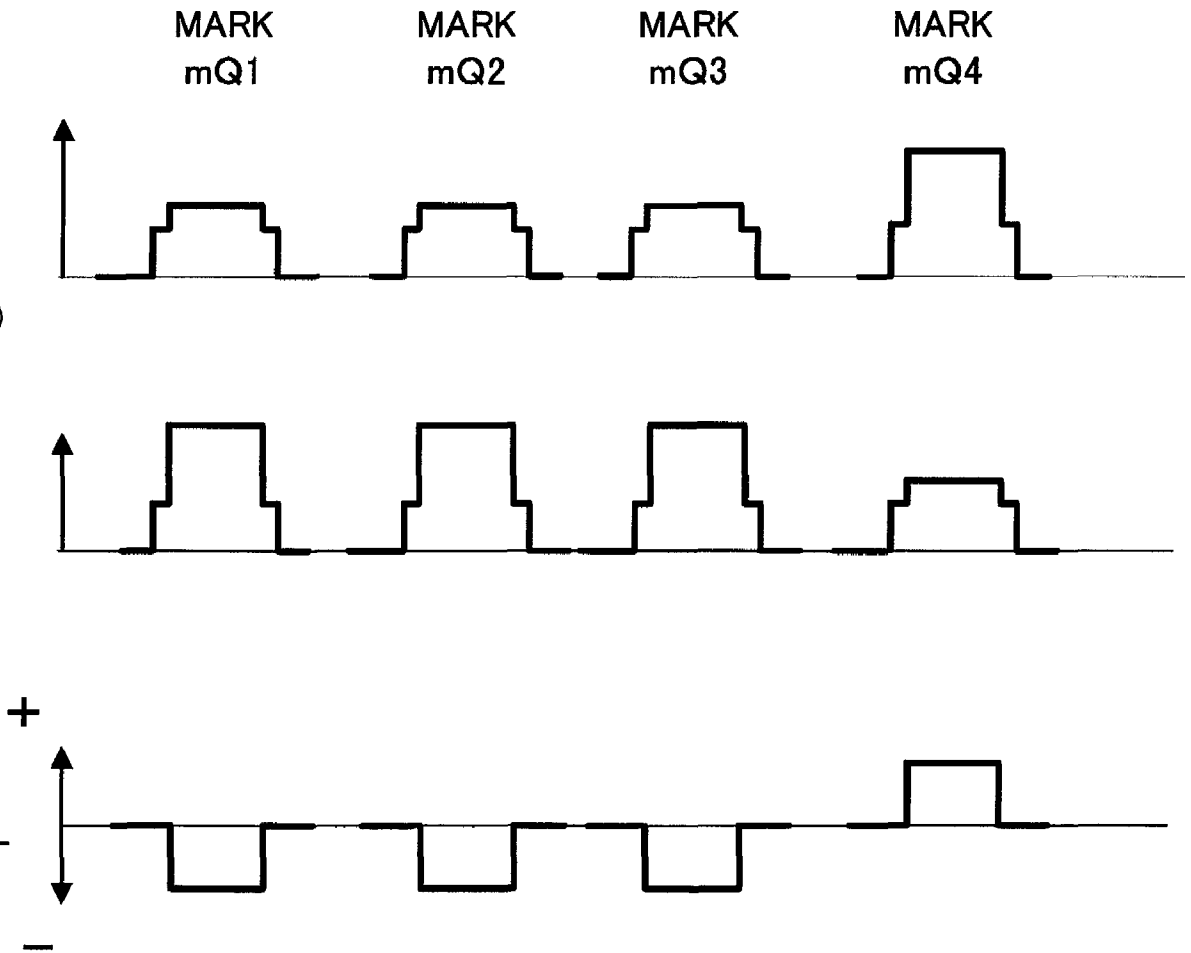
FIG. 16 represents the image signals for the four marks.

FIG. 16 represents the image signals for the four marks, in which FIG. 16A represents the first standard image with marks mQ1, mQ2, mQ3 and mQ4, FIG. 16B the second standard image with the four marks, and FIG. 16C the difference between the first and second images.

In step 304 of the flowchart in FIG.12, the portions relating to the four marks are extracted from the difference in FIG. 16C by means of the binarization with respect to a predetermined threshold level. In step S305, the sign of the extracted portion of difference in FIG. 16C is determined for each mark between plus sign and minus sign, which is recorded for each mark.

In step S306, the position of center of gravity for each of the extracted marks is calculated. And, the individual positions of the four marks are identified in step S307 on the basis of the position of center of gravity calculated in step S306 and the sign recorded in step S305. In other words, mark mQ4 can be distinguished from the other marks my means of the plus sign thereof different from the minus sign of the others. And, the other three marks can be identified in accordance with the predetermined arrangement as in FIG. 11 if mark mQ4 is once identified. If the individual positions of the marks are identified through step S307, the flow goes to step S308 to close the function.

Figure 17A:
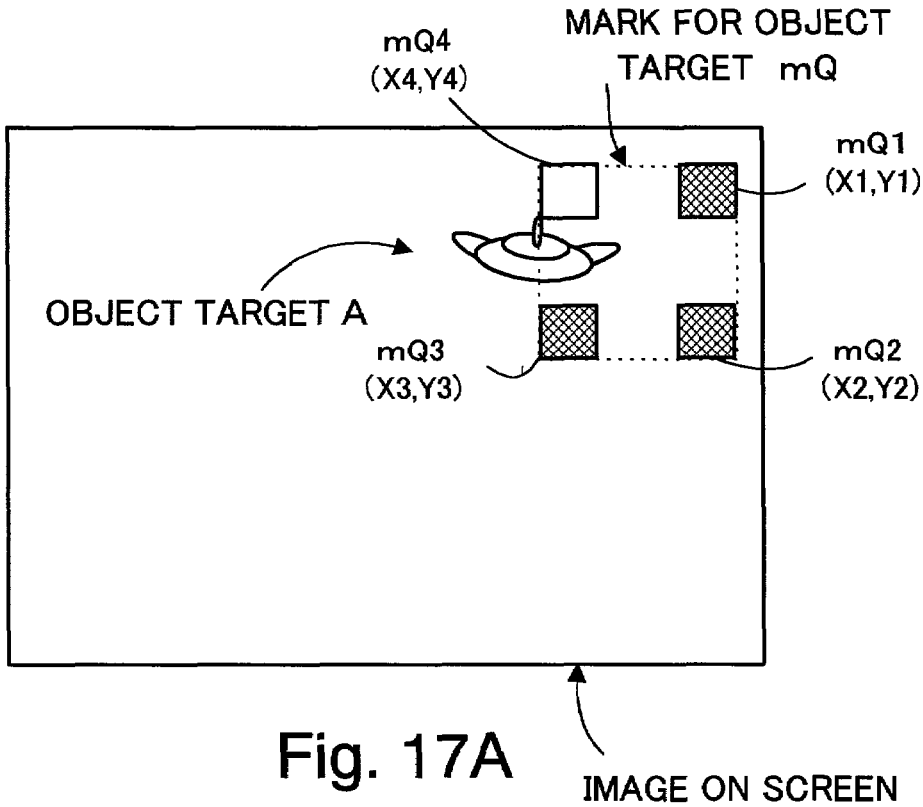
FIG. 17 represents an illustration of images for explaining the identification of the mark position.
Figure 17B:
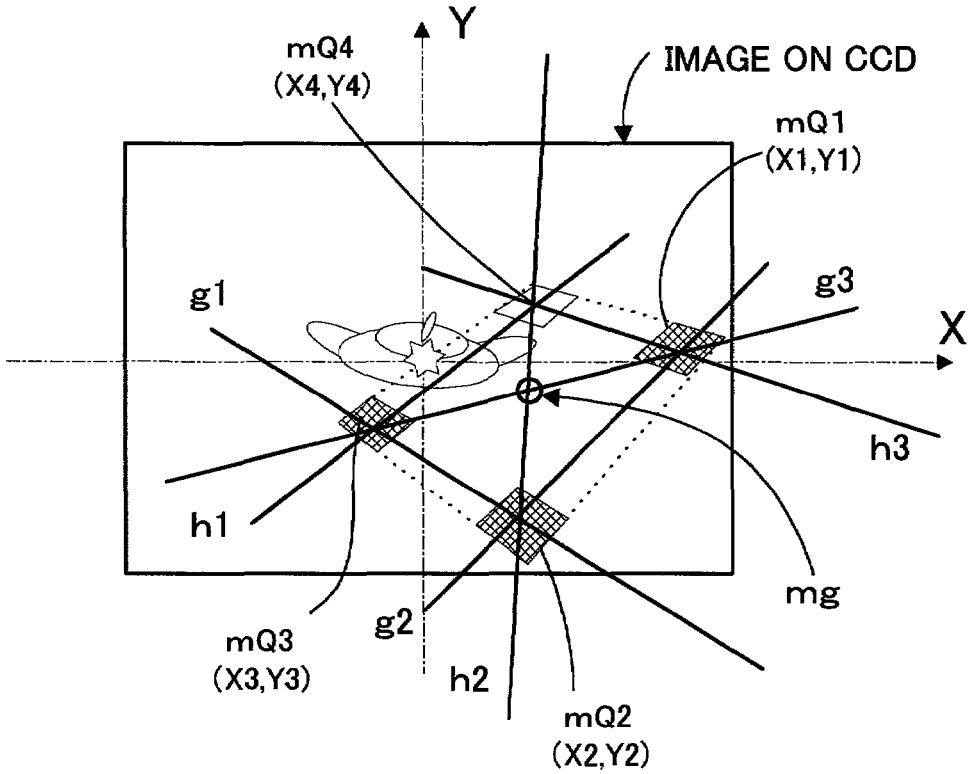

FIG. 17 represents an illustration of images for explaining the identification of the mark position, in which FIG. 17A represents the projected image on the wide screen. On the other hand, FIG. 17B represents the sensed image taken by CCD 101 of controller 100, in which the origin of X-Y coordinate is the position to be calculated on the basis of the identified mark positions.

Figure 18:
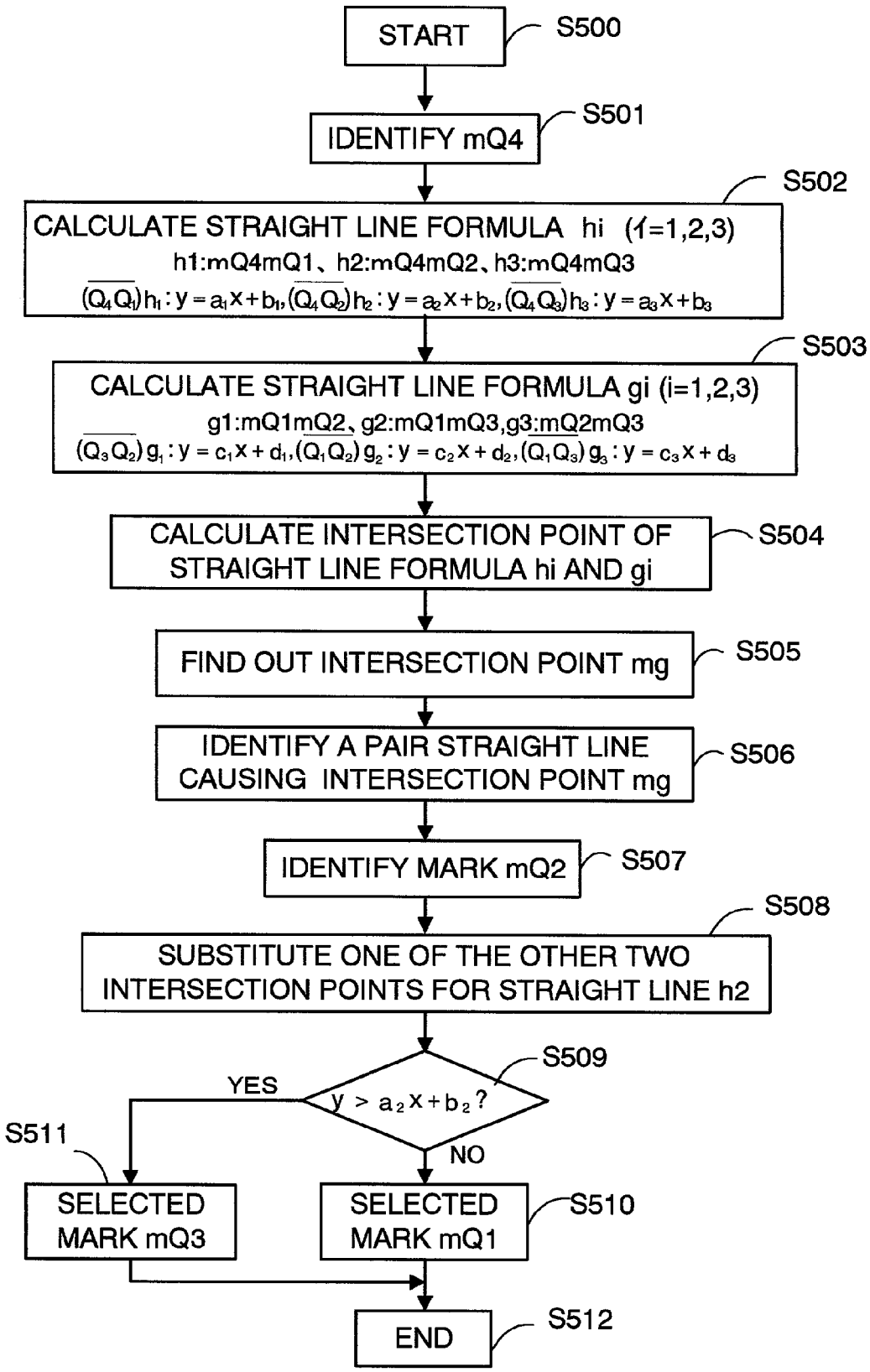
FIG. 18 represents a flowchart for identifying the mark positions.

FIG. 18 represents a flowchart for identifying the mark positions. The flow starting with step S500 makes the identification of mQ4 in step S501. In step S502, three formulas are calculated to represent three straight lines h1, h2 and h3 defined between the position of mQ4 and the other three mark positions, respectively. With respect to the other three mark positions in this stage, no one can tell which is which.

In step S503, three formulas are calculated to represent three straight lines g1, g2 and g3 defined between all possible pairs among the other three mark positions, respectively.

In step S504, all possible intersections between one group of straight lines h1 to h3 and the other groups of straight lines g1 to g3 are calculated. In step 505, the positions of the calculated intersections are compared with the four mark positions to find out intersection mg located at a position other than the four mark positions.

And, a pair of straight lines causing intersection mg is found out in step S506. Thus, straight line h2 and straight line g3 are identified as the pair of straight lines causing intersection mg. Then mQ2 can be identified on line h2 on the other side of mg than mQ4 in step S507.

With respect to mQ1 and mQ3 on straight line g3, discrimination is made in steps S508 and S509 to tell which is which. In step S508, one of the remaining mark positions is selected so that the coordinates of the selected mark position are substituted for x and y of the formula, y=a2x+b2 representing straight line h2. And, it is tested in step S509 whether or not the following conditions are both fulfilled:

$$y>a2x+b2 \text{ and } a2>0$$

If the answer is affirmative, the flow goes to step S510 for determining that the mark position selected in step S508 is mQ3. On the other hand, the flow goes to step S511 for determining that the mark position selected in step S508 is mQ1 if the answer is negative.

Thus, the last one mark position can be identified, and the flow is closed in step S512.

According to the present invention, the four marks necessary for calculating the aimed position, which is the origin of X-Y coordinate in the sensed image taken by CCD 101, is located close to the target object in the projected image. And the positions of the four marks are shifted along with the movement of the target object over the wide screen. Accordingly, the four marks can always be sensed on the image plane of CCD 101 as long as the player aims the target object with controller 100 even if the field angle of objective lens 102 is not so wide.

Figure 19A:
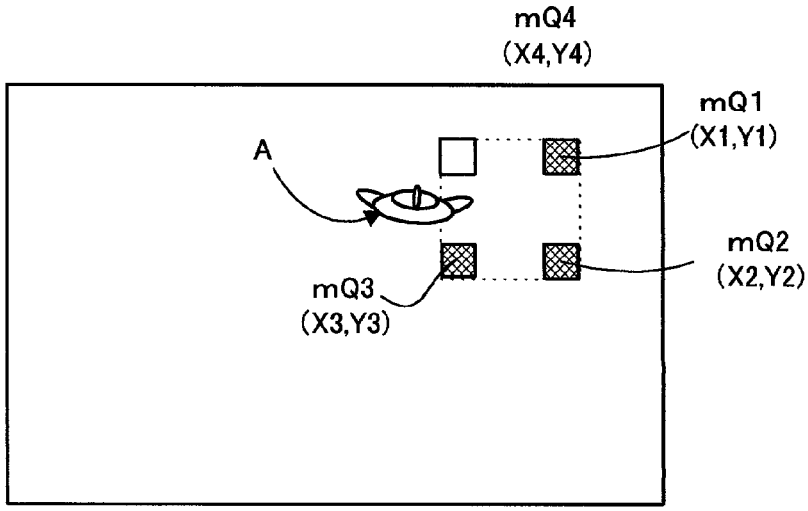
FIG. 19 represents the projected image on the wide screen
Figure 19B:
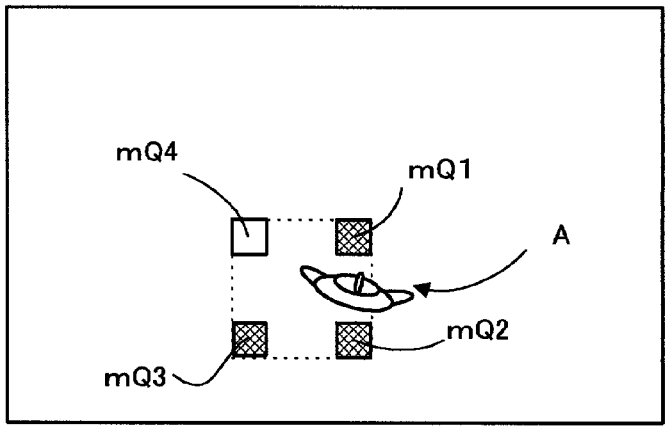
Figure 19C:
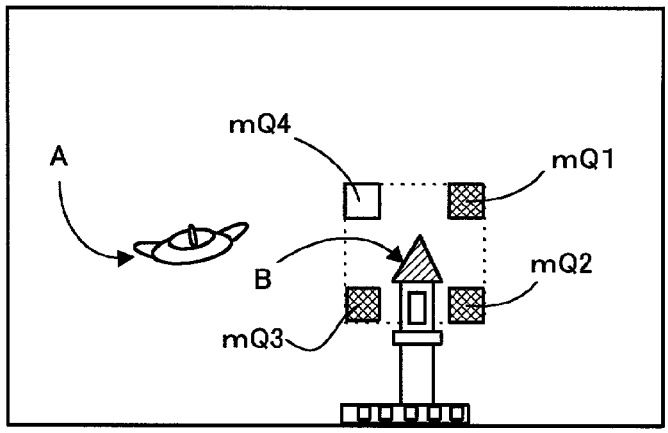

FIG. 19 represents the projected image on the wide screen in various cases for explaining the above feature. FIG. 19A represents a case in which flying object A as the target object is located in the upper-right portion of the wide screen, characteristic points mQ1, mQ2, mQ3 and mQ4 being located close to flying object. FIG. 19B represents a case in which flying object A moves toward the lower-left direction, characteristic points mQ1, mQ2, mQ3 and mQ4 keeping up flying object A. FIG. 19C represents a case in which spire B of a steeple as another target object is located in the central portion of the wide screen, characteristic points mQ1, mQ2, mQ3 and mQ4 being located not close to flying object A, but to spire B. This means that the player does not aim at flying object A, but at spire in the case of FIG. 19C.

For changing the target object to be aimed at, controller 100 includes a selector button for the player to designate one of the selectable target objects. Alternatively, an automatic designation of the target object is possible by means of automatically identifying a target object within the field angle of objective lens 102. Such identification is possible by having each of the target objects flicker with a predetermined different frequency. Thus, the target object coming into the field angle of objective lens 102 is identified in dependence on its frequency of flicker to automatically change the designation of the target object with characteristic points mQ1, mQ2, mQ3 and mQ4 located close thereto.

In all the cases in FIG. 19, the positions of the characteristic points are known no matter where the characteristic points located. Thus, the point where the player aims with controller 100 can be calculated as long as controller 100 senses the characteristic points.

[Second Embodiment]

Ordinary game machine outputs video signal with display scan frequency of 50 to 80 Hz (i.e., display scan period Tv of 1/50sec. to 1/80sec.) On the other hand, it takes time Tc (e.g., 1/50sec for PAL or 1/60sec. for NTSC in the case of ordinary video signal) for CCD to output signal for one entire image.

If period Tv does not so differ from time Tc with the former being shorter than the latter, the period three times as long as Tv for projecting the first standard image is sufficient for CCD to output the sensed first standard image as in the first embodiment.

On the contrary, a period two times as long as Tv for projecting the first standard image may be sufficient for CCD to output the sensed first standard image if period Tv is relatively longer than time Tc. This may also be possible if time Tc is successfully shortened so as to be shorter than period Tc. Thus, the projection of the first standard image by projector 130 may be substituted by that of the second standard image after a lapse of the period two times as long as Tv. The second embodiment in FIG. 20 is prepared to realize such a prompt substitution of the first standard image by the second standard image succeeding the termination of time Tc.

Figure 20:
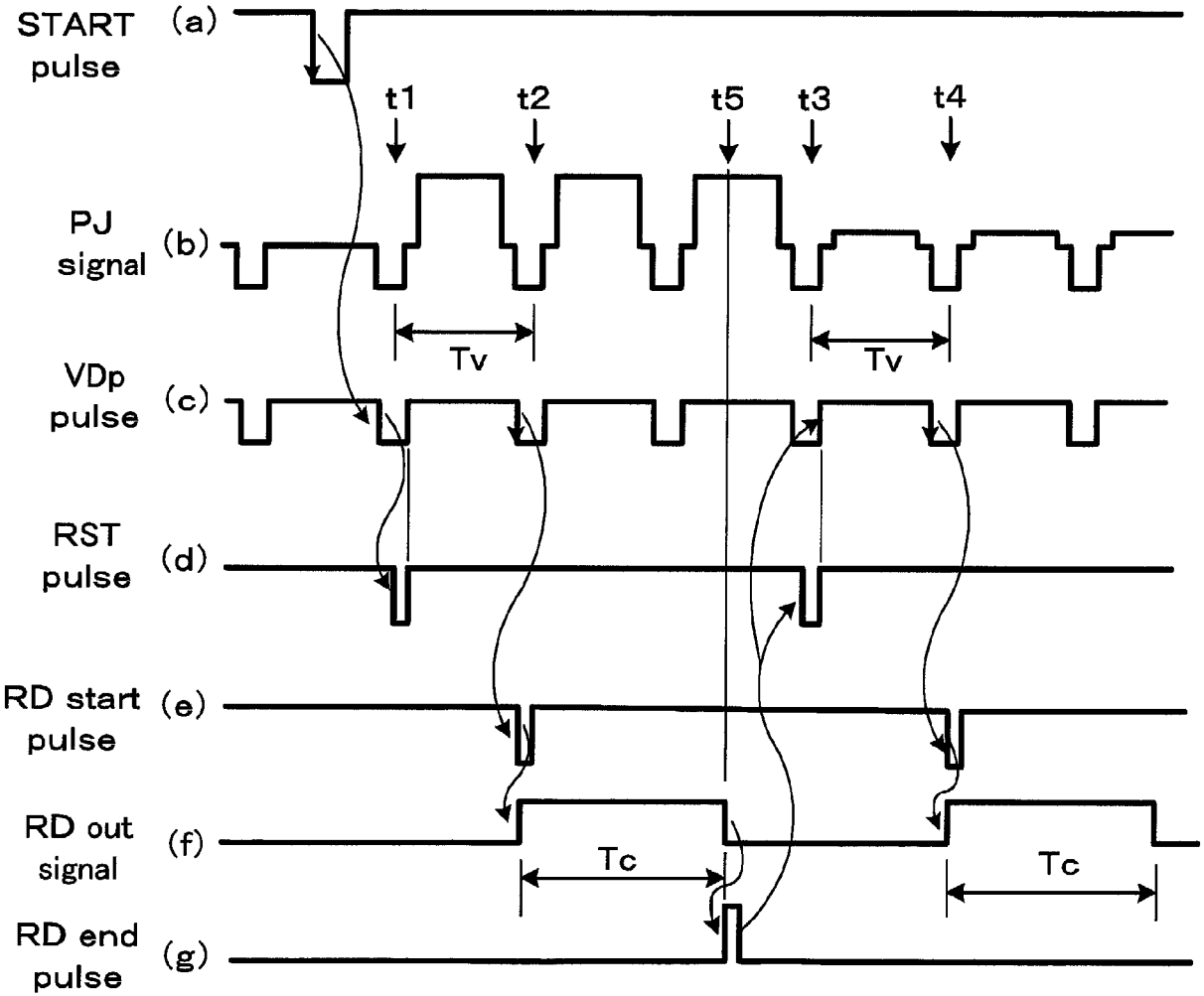
FIG. 20 represents a timing chart of the second embodiment.

FIG. 20(*a*) to FIG. 20(*f*) are similar to FIG. 14(*a*) to FIG. 14(*f*). In the second embodiment, however, RD end pulse as in FIG. 20(*g*) to be generated from timing generator 105 at time t5 upon the termination of reading out the sensed image from CCD is added. RD end pulse in FIG. 20(*g*) has main body 120 substitute the projection of the first standard image by that of the second standard image at time t3, at which the fist VDp pulse in FIG. 20(*c*) comes after the generation of RD end pulse at time t5. Further, RD end pulse in FIG. 20(*g*) causes main body 120 to generate RST pulse in FIG. 20(*d*).

In the case of FIG. 20 itself, the substitution of the first standard image by the second standard image succeeds the period three times as long as Tv, which is similar to FIG. 14, because period Tv is shorter than time Tc. If period Tv is made relatively longer than time Tc, however, the substitution of the first standard image by the second standard image would promptly succeed the period two times as long as Tv according to the second embodiment. According to the second embodiment, an additional controlling cable connects between controller 110 and main body 120 to transmit RD end pulse.

The prompt substitution of the first standard image by the second standard image succeeding the termination of reading out the sensed first standard image from CCD is also possible by modifying the first embodiment, in which RD end pulse and the cable for transmitting it as in the second embodiment are not necessary. In such a modification, main body 120 in the first embodiment includes a switch for changing the repetition of generating PJ signals from the period three times as long as Tv to a period two times as long as Tv if period Tv is relatively longer than time Tc. In other words, step S407 in FIG. 15 is modified to detect whether the third VDp signal (instead of the fourth VDp signal) comes if period Tv is relatively longer than time Tc.

Figure 21:
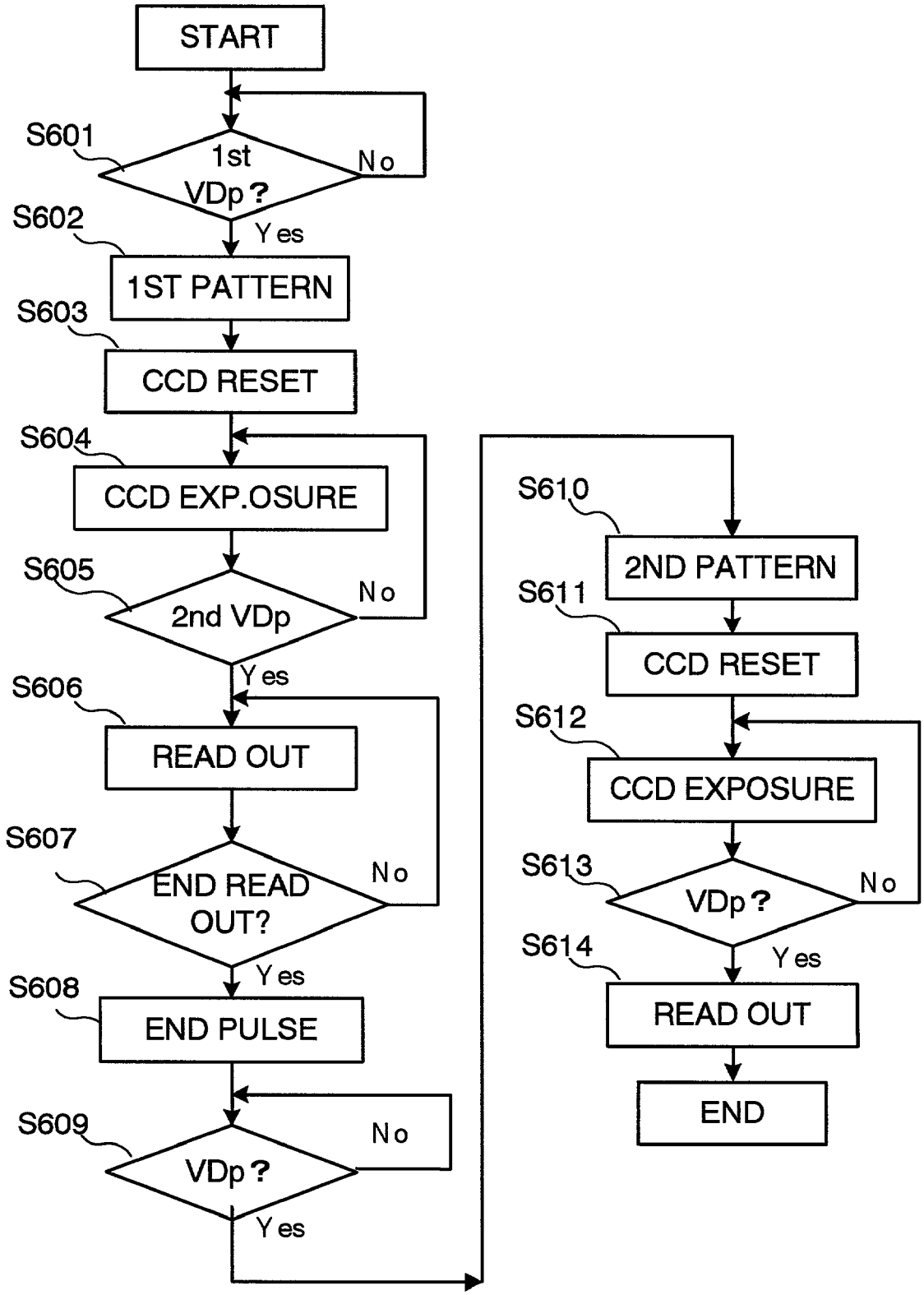
FIG. 21 represents a flowchart of the function of controller 100 according to the second embodiment.

FIG. 21 represents a flowchart of the function of controller 100 according to the second embodiment. Steps S601 to S606 from the projection of the first standard image to the reading out of the charge on CCD 101 are similar to steps S401 to S406 in FIG. 15.

In step S607*a*, it is checked whether or not the reading out of the charge on CCD is over. If the reading out is over at time t5, the flow advances to step S607*b*, in which timing generator 105 generates RD end pulse as in FIG. 20(*g*) for transmitting it through interfaces 107 and 121 to main body 120. In response to RD end pulse, the flow waits for the next VDp signal in step S608. If it is detected that the next VDp signal comes at time t3 in step S608, the flow advances to step S609, in which main body 120 switches the projection of the first standard image into the second standard image.

In step S610, timing generator 105 generates and transmits RST pulse to CCD 101. In step 611, CCD 101 is exposed to the second standard image. The exposure is continued until the generation of the next VDp signal is detected in step S612. In step S613, when the second exposure time is over at time t4, timing generator 105 generates and transmits RD start pulse as in FIG. 20(*e*) to CCD 101, which causes the reading out of the second standard image form CCD 101 during time Tc.

[Third Embodiment]

In the first and second embodiments, CCD 101 is exposed to the standard image for period Tv, which is one display scan period. However, in the case of CCD of lower sensitivity, the exposure for only one display scan period would be insufficient for getting the expected level of image signal. The third embodiment is designed with such a case taken into consideration.

Figure 22:
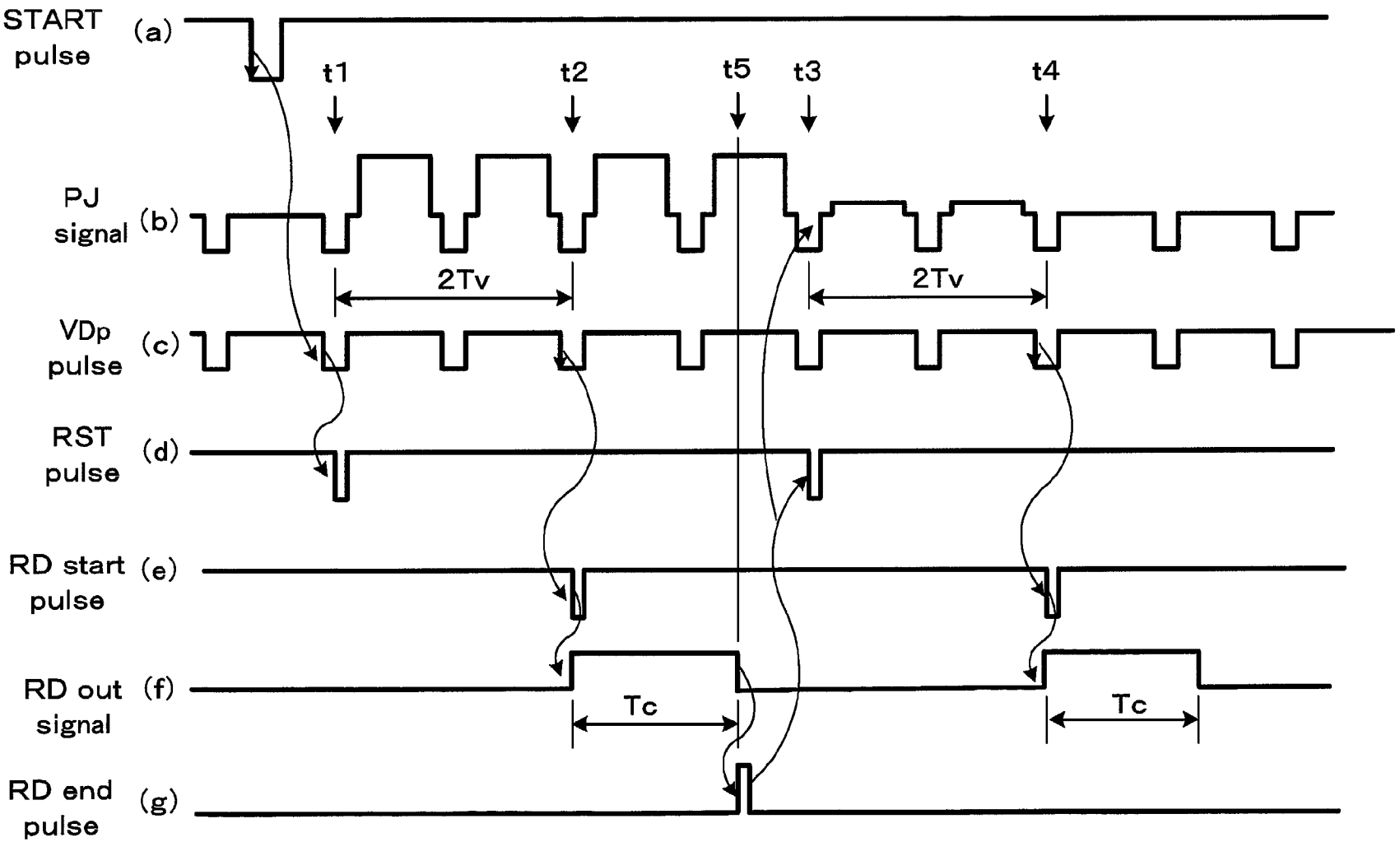
FIG. 22 represents a timing chart of the function of controller 100 according to the third embodiment.

FIG. 22 represents a flowchart of the function of controller 100 according to the third embodiment. FIG. 22(*a*) to FIG. 20(*g*) can be understood in the similar manner to that in FIG. 20(*a*) to FIG. 20(*g*) in the second embodiment.

In the third embodiment, however, timing generator 105 is modified to generate RD start pulse at time t2 with period two times as long as Tv passed after the transmission of RST pulse to CCD 101 as in FIG. 22(*e*). Thus, CCD 101 is exposed to the standard image with double amount of light, which increases the level of image signal with undesired influence of flicker modulated. According to the concept of the third embodiment, timing generator 105 may be further modified to generate RD start pulse with period three or more times as long as Tv if CCD requires more amount of light exposed.

According to the present invention, various types of further modification of the embodiment are possible. For example, the four detection marks forming a rectangular may be modified into other type of geometric pattern. Or, the first and second standard images of different illumination may be modified into a pair of standard images of different contrast.

As in FIG. 15 or FIG. 20 or FIG. 22, the embodiment according to the present invention designs CCD to be exposed for display scan period Tv or a period integer times as long as Tv. Thus, the detection marks or the like can be completely sensed by CCD without being chipped regardless of the location thereof in the wide screen. This makes it possible for the detection marks or the like to be located close to the target object in the projected image no matter where the target object is located in the wide screen.

What is claimed is:

1. A position detector for detecting a position on a given plane, the position detector comprising:

a first controller that displays a target point on the given plane;

a second controller that displays a known standard on the given plane in a vicinity of the target point, the location of the standard being known;

an image sensor having an image plane on which an image that includes an image of the standard is formed, the image plane having a predetermined position;

an image processor that identifies the image of the standard on the image plane; and a processor that calculates a position of a point on the given plane corresponding to the predetermined position on the image plane using parameters of an attitude of the image plane relative to the given plane based on the identified image of the standard.

2. The position detector according to claim 1, wherein the first controller displays the target point at different positions on the given plane, and wherein the second controller displays the known standard at different positions on the given plane in correspondence to the different positions of the target point.

3. The position detector according to claim 1, wherein the first controller displays one of different target points on the given plane, and wherein the second controller displays the known standard in the vicinity of the one of the different target points on the given plane.

4. The position detector according to claim 1, wherein the known standard includes asymmetric pattern.

5. The position detector according to claim 4, wherein the asymmetric pattern includes four marks forming a rectangle, one of the four marks being distinguishable from the others.

6. The position detector according to claim 1, wherein the known standard includes a first standard and a second standard sequentially displayed on the given plane, wherein the image sensor senses a first image that includes an image of the first standard and a second image that includes an image of the second standard, and wherein the processor includes a calculator that calculates a difference between the first image and the second image to identify the image of the standard.

7. The position detector according to claim 6, wherein the processor determines whether the difference is positive or negative at the identified standard.

8. The position detector according to claim 1, wherein the first controller forms an image by scanning the given plane, the target point is displayed as a part of the image formed by the scanning, and wherein the second controller displays the known standard as a part of the image formed by the scanning.

9. The position detector according to claim 8, wherein the image sensor reads out the sensed image upon the termination of at least one period of the scanning.

10. The position detector according to claim 8, wherein the known standard includes a first standard and a second standard sequentially displayed on the given plane, and wherein the second controller starts displaying the second standard upon the initiation of the scanning after the image sensor completes the reading out of the sensed image including the first standard.

11. A position detector for detecting a position on a given plane, the position detector comprising:

a controller that displays a known standard including an asymmetric pattern on the given plane;

an image sensor having an image plane on which an image that includes an image of the standard is formed, the image plane having a predetermined position;

an image processor that identifies the image of the standard on the image plane; and a processor that calculates a position of a point on the given plane corresponding to the predetermined position on the image plane using parameters of an attitude of the given plane relative to the image plane based on the identified image of the standard.

12. The position detector according to claim 11, wherein the asymmetric pattern includes four marks forming a rectangle, one of the four marks being distinguishable from the others.

13. A position detector for detecting a position on a given plane, the position detector comprising:

a controller that displays on the given plane a known standard including a first standard and a second standard, the controller sequentially displaying the first standard and the second standard;

an image sensor having an image plane on which an image of the given plane is formed, a point in the image of the given plane which is formed at a predetermined position of the image plane corresponding to a point to be detected on the given plane, the image sensor sensing a first image that includes an image of the first standard and a second image that includes an image of the second standard;

an image processor that calculates a difference between the first image and the second image to identify the image of the standard on the image plane, the image processor determining whether the difference is positive or negative at the identified standard; and a processor that calculates the position of the point to be detected on the basis of the identified image of the standard on the image plane.

14. The position detector according to claim 13, wherein the first standard and the second standard include a plurality of marks, respectively, the marks of the second standard being located at the same positions of the marks of the first standard with the pattern formed by the marks in the second standard being a reversal of that in the first standard.

15. An attitude detector for detecting an attitude of a given plane, the attitude detector comprising:

a controller that displays on the given plane a known standard including a first standard and a second standard, the controller sequentially displaying the first standard and the second standard;

an image sensor having an image plane on which an image of the given plane is formed, the image sensor sensing a first image that includes an image of the first standard and a second image that includes an image of the second standard;

an image processor that calculates a difference between the first image and the second image to identify the image of the standard on the image plane, the image processor determining whether the difference is positive or negative at the identified standard; and a processor that calculates the attitude of the given plane on the basis of the identified image of the standard on the image plane.

16. The attitude detector according to claim 15, wherein the first standard and the second standard include a plurality of marks, respectively, the marks of the second standard being located at the same positions of the marks of the first standard with the pattern formed by the marks in the second standard being a reversal of that in the first standard.

17. A detector for detecting a standard on a given plane, the detector comprising:

a controller that forms an image on the given plane by scanning the given plane, the controller displaying the standard as a part of the image on the given plane formed by the scanning;

an image sensor having an image plane on which an image of the given plane is formed, the image including an image of the standard, a point in the image of the given plane which is formed at a predetermined position of the image plane corresponding to the point to be detected on the given plane, the image sensor reading out the sensed image upon termination of at least one period of the scanning;

an image processor that identifies the image of the standard on the image plane; and a processor that calculates a position of the point to be detected on the given plane based on the identified image of the standard on the image plane.

18. A detector for detecting a standard on a given plane, the detector comprising:

a controller that forms an image on the given plane by scanning the given plane, the controller displaying the standard as a part of the image on the given plane formed by the scanning, the standard including a first standard and a second standard to be sequentially displayed;

an image sensor having an image plane on which an image of the given plane is formed, the image sensor sensing a first image that includes an image of the first standard and a second image that includes an image of the second standard; and an image processor that identifies the image of the standard on the image plane in accordance with the first image and the second image, wherein the controller starts displaying the second standard upon the initiation of the scanning after the image sensor completes the reading out of the sensed image that includes the first standard.

19. A position detector for detecting a position on a display plane, the position detector comprising:

an image generator that displays at least one standard mark in a vicinity of a target point on the display plane;

an image sensor having an image plane on which an image that includes an image of the standard is formed, a predetermined position of the image plane corresponding to a predetermined point;

an image processor that identifies the image of the standard on the image plane; and a processor that calculates a position of the predetermined point on the display plane using parameters of an attitude of the image plane relative to the display plane on the basis of the identified image of the standard.

* * * * *